US007160663B2

(12) United States Patent
Komoto et al.

(10) Patent No.: US 7,160,663 B2
(45) Date of Patent: Jan. 9, 2007

(54) TONER

(75) Inventors: Keiji Komoto, Shizuoka (JP); Yasushi Katsuta, Shizuoka (JP); Yushi Mikuriya, Shizuoka (JP); Takeshi Kaburagi, Shizuoka (JP); Emi Tosaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 10/808,401

(22) Filed: Mar. 25, 2004

(65) Prior Publication Data

US 2005/0026063 A1 Feb. 3, 2005

(30) Foreign Application Priority Data

Jul. 29, 2003 (JP) ..... 2003-281761
Feb. 25, 2004 (JP) ..... 2004-049917

(51) Int. Cl.
*G03G 9/087* (2006.01)

(52) U.S. Cl. ..... 430/109.1; 430/108.6; 430/108.7

(58) Field of Classification Search ..... 430/109.1, 430/108.6, 108.7, 137.15
See application file for complete search history.

(56) References Cited

U.S. PATENT DOCUMENTS

| | | | | |
|---|---|---|---|---|
| 4,883,735 | A | 11/1989 | Watanabe et al. | 430/109 |
| 5,858,597 | A | 1/1999 | Mizoh et al. | 430/110 |
| 6,638,674 | B1 | 10/2003 | Komoto et al. | 430/106.1 |
| 6,667,146 | B1 | 12/2003 | Tosaka et al. | 430/108.23 |
| 2002/0048010 | A1 | 4/2002 | Inaba et al. | 355/133 |
| 2003/0186152 | A1* | 10/2003 | Ohno et al. | 430/108.8 |

FOREIGN PATENT DOCUMENTS

| | | |
|---|---|---|
| JP | 56-13945 | 4/1981 |
| JP | 63-184762 | 7/1988 |
| JP | 00-56518 | 2/2000 |
| JP | 001-343788 | 12/2001 |
| JP | 2-108019 | 4/2002 |

* cited by examiner

*Primary Examiner*—John L Goodrow
(74) *Attorney, Agent, or Firm*—Fitzpatrick, Cella, Harper & Scinto

(57) ABSTRACT

A toner includes toner particles and an inorganic fine powder mixed with the toner particles. The toner particles contain a binder resin, a coloring agent, a releasing agent, and a sulfur-containing resin. The toner particles contain at least one element selected from the group consisting of magnesium, calcium, barium, zinc, aluminum, and phosphorus and satisfy the relationship:

$$4 \leqq T/S \leqq 30$$

wherein T represents the total content of the element in ppm, and S represents the content of sulfur in ppm. The weight-average particle diameter (D4) of the toner is in the range of 3 to 10 μm. The average circularity of the toner is within the range of 0.950 to 0.995.

18 Claims, 6 Drawing Sheets

TONER

BACKGROUND OF THE INVENTION

1. Field of the Invention

The present invention relates to a toner for use in recording processes such as electrophotographic processes, electrostatic recording processes, electrostatic printing processes, and the like.

2. Description of the Related Art

To date, many electrophotographic recording processes are known. In a typical electrophotographic process, an electrical latent image is formed by a variety of methods on a member for carrying an electrostatic image, hereinafter simply "photosensitive member", using a photoconductive material, and is developed into a visible toner image using a toner. The toner image is transferred onto a suitable recording medium, such as paper, and is then fixed on the recording medium by application of heat, pressure, or the like, to obtain a copy.

Examples of the methods for forming visible toner images from electrical latent images include cascade development; magnetic-brush development; pressure development; magnetic-brush development with a two-component developer containing a carrier and a toner; noncontact single-component development in which toner is transferred from a toner supporting member onto a photosensitive member without the photosensitive member making contact with the toner supporting member; contact single-component development in which a toner supporting member is pressed against a photosensitive member to transfer the toner by an electric field; and jumping development using a magnetic toner.

Recent technical trends require electrophotographic apparatuses, such as printers, to have higher resolutions as measured in dots per inch (dpi). The desired resolutions are now 1,200 dpi and 2,400 dpi, which are higher than the 300 dpi and 600 dpi conventionally required. Higher resolutions require finer development systems. Moreover, recent copying machines incorporate digital technology to achieve advanced functions. In particular, copying machines now use lasers to produce electrostatic images to achieve higher resolutions. As with printers, copy machines also require high-resolution, fine development systems.

Furthermore, the field of electrophotography has seen rapid development of color printing. Since color images are developed by adequately superimposing yellow, magenta, cyan, and black toners, toners are required to have characteristics suitable for such development (hereinafter referred to as "development characteristics"), which are different from those required in a single toner process. Accordingly, the electrification of the toners must be uniformly controlled.

In order to control the electrification of toners, charge control agents are conventionally used. In general, charge control agents can be roughly classified into two types, namely, (i) complex compounds having complex structures in which ligand components coordinate with central metals and (ii) polymer compounds containing polar functional groups that function as the charging sites. Complex compounds are crystalline and exhibit low compatibility with binder resins; accordingly, a toner production method must be carefully selected and controlled to uniformly disperse such complex compounds. In contrast, charge control agents of a polymer compound type, which are highly compatible with resins, can easily form homogeneous dispersions; accordingly, fewer limitations are imposed on the process using this type of agent. An example of the polymer compound charge control agent is a resin containing a polymerizable polymer of a particular structure. For example, Japanese Patent Laid-Open No. 63-184762 discloses such a polymer compound charge control agent.

In an electrophotographic process, a toner image produced on a photosensitive member by development is transferred onto a recording member in a transfer step. The remaining toner in the image area and the fogging toner in the non-image area on the photosensitive member are removed in a cleaning step and stored in a waste toner storage. In a conventional cleaning step, a blade, a fur-brush, a roller, or the like has been used. These components require a large space and prevent size reduction of the apparatuses. Moreover, from the standpoint of ecology, a system with less waste toner and a toner having high transfer efficiency while causing less fogging are desired.

The transfer efficiency is known to decrease due to degradation in releasability of the toner from the photosensitive drum. The degradation occurs when the circularity or sphericity of the toner is low because a toner with low circularity or sphericity increases the area of contact between the toner and the photosensitive drum. Moreover, since the surface of such a toner has large irregularities, charges concentrate on edges and the so-called image force at the locations corresponding to these edges increases as a result.

The process of achieving high toner circularity differs depending on the method for making the toner. Methods for making commercial toners can be roughly classified into pulverization methods and polymerization methods. In pulverization methods, a binder resin, a coloring agent, and the like are thoroughly mixed by melting to obtain a homogeneous mixture. The mixture is then pulverized in a fine grinding mill and classified with a classifier to obtain a toner having a predetermined particle diameter. The toner obtained by the pulverization methods has irregularities in the surface since the surface has fractures resulting from milling. Accordingly, an additional process, such as applying mechanical impact, heat, or the like, is necessary to improve the surface quality and to achieve sufficiently high circularity.

Polymerization methods can be classified into two types, namely, association/aggregation methods and suspension polymerization methods. In the association/aggregation method, resin particles, a coloring agent, a releasing agent, and the like are associated or aggregated into particles of a predetermined diameter in an aqueous medium containing emulsion-polymerized resin particles as the binder resin component. In the suspension polymerization method, a polymerizable monomer composition containing a coloring agent, a releasing agent, a polymerization initiator and the like dispersed or dissolved in a polymerizable monomer (binder resin component) is prepared. The polymerizable monomer composition is then placed in an aqueous medium, formed into droplets of a predetermined diameter by application of shear force, and is suspension-polymerized to provide a toner.

The toner prepared by the association/aggregation method also has irregularities on the surface; thus, an additional process of heating the toner, adding another polymerizable monomer composition to perform seed polymerization, or the like is necessary to improve the surface quality. The toner prepared by suspension polymerization methods has fewer irregularities and is more spherical compared to other toners since the toner is polymerized in droplets. No additional process is required to achieve high circularity. An example of this type of toner is disclosed in Japanese Patent Laid-Open No. 2001-343788. As is described above, a toner capable of uniform electrification and having high transfer efficiency can be prepared by suspension polymerization using a charge control agent of a polymer compound type. An example of such a technique is disclosed in Japanese Patent Laid-Open No. 2000-056518.

Moreover, a toner can be stably and efficiently prepared by suspension polymerization using a water-insoluble inorganic salt as the dispersion stabilizer. Such a technique is disclosed in Japanese Patent Laid-Open No. 2002-108019.

As is described above, the transfer efficiency can be improved by increasing the circularity of the toner. However, some of the toner will remain on the photosensitive member after the transfer step unless the transfer efficiency is 100%. Thus, a cleaning step for removing the remaining toner is necessary. In the cleaning step, a toner having high circularity and thus high flowability is difficult to remove since the toner can pass under the cleaning blade. Accordingly, when the toner has high charge, an image force operates between the image carrying member and the toner, and thus the toner becomes difficult to remove in the cleaning step.

On the other hand, when the toner has low charge, the toner tends to scatter into a development unit or the like, thereby contaminating the interior of the printer, copy machine, or the like. The contamination may cause image quality degradation, image contamination, and defects in the apparatus.

Thus, a highly circular toner prepared with a charge control agent of a polymer compound type rarely satisfies all of the properties required in development, charging, and cleaning.

SUMMARY OF THE INVENTION

It is an object of the present invention to provide a toner that exhibits stable charge characteristics regardless of the environment, forms high quality images, causes less scattering, and can be easily removed in the cleaning step.

In particular, the present invention provides a toner containing toner particles and an inorganic fine powder mixed with the toner particles. The toner particles contain a binder resin, a coloring agent, a releasing agent, and a sulfur-containing resin. The toner particles contain at least one element selected from the group consisting of magnesium, calcium, barium, zinc, aluminum, and phosphorus and satisfy the relationship:

$$4 \leqq T/S \leqq 30$$

wherein T represents the total content of the element in ppm, and S represents the sulfur content in ppm. The weight-average particle diameter (D4) of the toner is in the range of 3 to 10 μm. The average circularity of the toner is within the range of 0.950 to 0.995.

Further objects, features and advantages of the present invention will become apparent from the following description of the preferred embodiments (with reference to the attached drawings).

DESCRIPTION OF THE PREFERRED EMBODIMENTS

Figure 1:
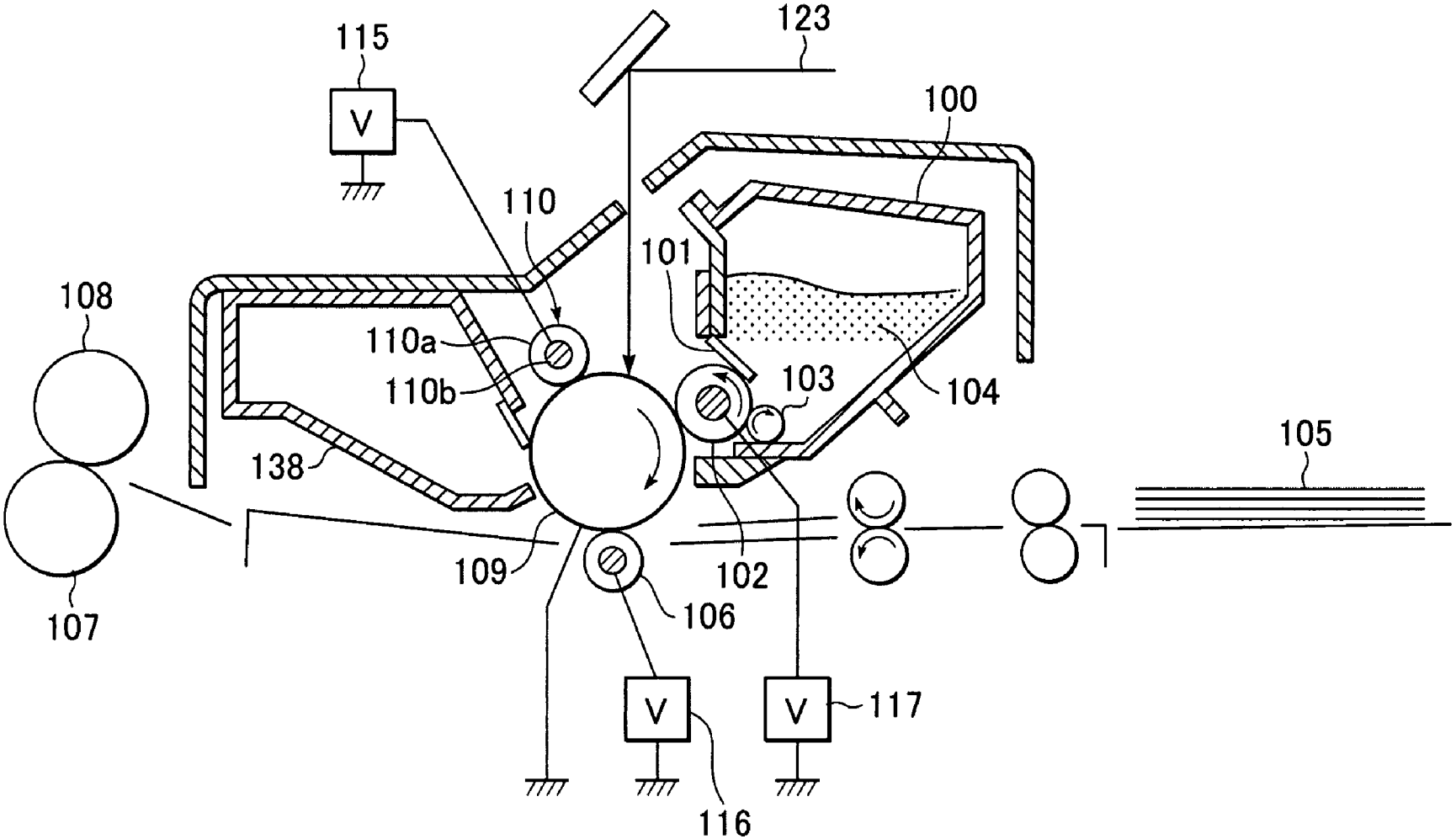
FIG. 1 is a schematic diagram of an example of a development apparatus used in the present invention.

A toner of the present invention contains a sulfur-containing resin and is constituted from particles having a high circularity and a diameter within a predetermined range. In the toner, the ratio of the sulfur content to the total content of at least one element selected from the group consisting of magnesium, calcium, barium, zinc, aluminum, and phosphorus is adjusted within a predetermined range to achieve sufficient development characteristics and charge properties, while facilitating cleaning and preventing scattering of the toner inside the apparatus. The toner achieves these effects when used in a full-color printer.

In general, a charge control agent of a polymer compound type has a resistance higher than that of a complex compound and thus produces overcharged toner particles by charge transfer. Since the overcharged particles tightly adhere onto the photosensitive member, the toner cannot be completely removed from the surface of the photosensitive member, which results in cleaning failure. A conventional method that uses a toner prepared by suspension polymerization and a charge control agent of a polymer compound type is known in which degradation of image characteristics in a high-temperature high-humidity environment is said to prevented by regulating the amount of the remaining dispersion stabilizer. However, this method does not teach the correlation between the polymer compound charge control agent and the cleaning failure in a low-temperature and low-humidity environment.

The present inventors have examined the correlation between the polymer compound charge control agent and cleaning failure at a low-temperature and low-humidity environment. The Inventors have also investigated toner scattering, which is technically difficult to overcome. As a result, the inventors have discovered a toner which is free of cleaning failure and toner scattering and which can produce high-quality images irrespective of the environment.

The present invention will now be described in detail.

A toner becomes increasingly difficult to remove from a photosensitive member as the circularity of toner particles increases. This tendency is accelerated in a low-temperature-low-humidity environment due the following reasons. In a development unit, a toner is transferred onto a photosensitive member, during which a toner component having a higher charge tightly adheres to the surface of the photosensitive member due to the high image force. In a low-temperature-low-humidity environment, a toner can be readily overcharged and the percentage of the overcharged component in the toner increases as a result. Thus, the toner tightly adhered on the photosensitive member cannot be removed with a cleaning blade or a cleaning roller, thereby resulting in cleaning failure.

Cleaning failure may be prevented by decreasing the charge of the toner; however, this causes degradation of development properties and toner scattering in a high-temperature and high-humidity environment.

The inventors have carefully investigated the overcharged component in the toner and have discovered a method for optimizing the charge of the overcharged component in the toner containing a polymer compound charge control agent. A polymer compound charge control agent generally has a slightly nonuniform distribution in the number of charge sites. Among the components of the charge control agent, a component containing a large number of charge sites induces the production of an overcharged component in the toner. Thus, a predetermined percentage of at least one element selected from magnesium, calcium, barium, zinc, aluminum, and phosphorus is added to interact with the component containing a large number of charge sites. As a result, the amount of the overcharged component in the toner can be reduced without decreasing the total charge of the toner while preventing cleaning failure and toner scattering. The present invention is made based on the fact that the aforementioned particular elements readily interact with the component containing a large number of charge sites in the charge control agent. The inventors have also found that an organic dispersion stabilizer used in toner fabrication can be used as the element capable of interacting with the polymer compound charge control agent.

The toner of the present invention yields the above-described effects due to the following reasons. A toner having smaller particles is advantageous in obtaining a superfine or high resolution image and a toner having a high circularity is advantageous for uniform charging. A toner with smaller particles and high circularity thus forms a superfine image. However, such a toner is likely to cause cleaning failure. Moreover, when such a toner is used with a polymer compound charge control agent, frequent cleaning failures occur due to its high resistance and the presence of the overcharged component in the toner in a low-temperature and low-humidity environment.

In the toner of the present invention, the relationship between the amount of sulfur, which promotes electrification, and the amount of the component that inhibits electrification is controlled to prevent both cleaning failure and toner scattering. Here, the component that inhibits electrification is at least one element selected from magnesium, calcium, barium, zinc, aluminum, and phosphorus, hereinafter simply referred to as "Group 1 element".

The ratio of the content T of the Group 1 element in the toner particles to the sulfur content S in the toner particles, i.e., the ratio T/S, must be in the range of 4 to 30. The balance between the amount of the Group 1 element primarily functioning as the leak site and the amount of sulfur functioning as the charge site is strongly related to prevention of cleaning failure and toner scattering when the toner has a diameter within a predetermined range and an average circularity within a predetermined range. When the ratio T/S is smaller than 4, the sulfur content is excessively small relative to the content of the Group 1 element functioning as the leak site. This may result in excess charge-up, cleaning failure, and image quality degradation due to the overcharged component in the toner. When the ratio exceeds 30, the Group 1 element functioning as the leak site becomes excessive. Accordingly, the charge of the toner does not reach the level required in electrophotographic processes, resulting in toner scattering and lower image quality. In order to control the ratio T/S, the content of the sulfur and the content of the Group 1 element in the toner must be controlled.

In a suspension polymerization toner fabrication method preferred in the present invention, the T/S is determined from the interaction between the polymer compound charge control agent and the Group-1-element-containing compound used as the suspension stabilizer. In this method, the ratio T/S varies according to the distribution of sulfur atoms even though the amount of sulfur is fixed at a predetermined level.

For example, when the charge control agent contains a large amount of a high-charge-site component in which the distance between adjacent charge sites is small and the concentration of neighboring charge sites is high, the high-charge-site component when placed into contact with the Group 1 element tends to surround the Group 1 element due to a strong interaction between the high-charge-site component and the Group 1 element and due to the short distance between the adjacent charge sites, thereby yielding a large ratio T/S. When this tendency is amplified, the Group 1 element becomes completely hidden and no longer functions as the leak site for leaking charges, resulting in excess charge-up. Since most of the charge sites of the charge control agent interact with the Group 1 element, the number of charge sites decreases, and the charge can no longer be controlled. This may cause toner scattering due to a decreased charge in a high-humidity environment or may cause cleaning failure due to excess charge-up in a low-humidity environment.

In the present invention, the combination of the polymer compound charge control agent and the Group 1 element yields an adequate interaction and is most suitable for achieving the effects of the present invention. Although the reason for this is not clearly known, the inventors assume that the ionic radius, the electro-negativity, or the like of the Group 1 element causes such effects.

When the distance between adjacent charge sites is adequate and the interaction with the Group 1 element is sufficiently weak, the polymer compound charge control agent no longer surrounds the Group 1 element, and charge sites can function properly. Moreover, the amount of the remaining Group 1 element can be decreased. Since certain positions of the charge sites readily interacting with the Group 1 element tend to have a charge site density, the distribution of toner charge can be narrowed due to the concentration of the charge sites.

However, when the distribution of the charge sites becomes completely uniform, the interaction between the Group 1 element and sulfur becomes excessively weak. Accordingly, the amount of the Group 1 element decreases; the ratio T/S decreases; charge-up occurs due to deficiency of the leak sites; and extensive cleaning failure and image quality degradation occur as a result. The inventors have comprehensively considered all of the aforementioned phenomena in defining the range of T/S capable of preventing degradation of the image quality. Moreover, in suspension-polymerized toners, components with higher polarity tend to appear on the surface of particles. Thus, when the sulfur-containing resin exists on the toner surface, the above-described effects of the invention can be further promoted.

The value T (ppm) of the Group 1 element is preferably in the range of 100 to 2,000 since T exceeding 2,000 causes toner scattering and T less than 100 causes cleaning failure. More preferably, T is in the range of 100 to 1,500 and most preferably 100 to 1,000. In the present invention, values T and S are determined as follows. A calibration curve is drawn using a standard sample by fluorescent X-ray analysis, and each value is determined based on the calibration curve. The analysis is carried out according to Japanese Industrial Standards (JIS) K 0119 (1987) using a fluorescent X-ray analyzer, SYSTEM 3080 (manufactured by Rigaku Corporation)

In general, finer toner particles whose diameter is smaller than the average tend to spread over the background, thereby causing fogging. The inventors have found through extensive investigations that the toner of the present invention can prevent fogging and cleaning failure since the sulfur content in the finer toner particles is sufficiently large. The exact reason for this phenomenon is not clear, but the inventors consider that charges of the finer particles are responsible for this phenomenon. In the present invention, cleaning failure can be prevented when the following relationship is satisfied: (S-f)≧(S-m) wherein (S-f) represents the sulfur content in finer particles obtained by air-classifying the toner and (S-m) represents the sulfur content in the toner. In the present invention, the finer particles are air-classified particles, which satisfy the following relationship:

$$\{D4 \text{ of the toner} \times 0.7\} \leqq D4 \text{ of the finer particles} \leqq \{D4 \text{ of the toner} \times 0.8\},$$

wherein D4 represents the weight average particle diameter.

In the present invention, the "sulfur-containing resin" refers to a resin preferably having a peak top in the range of 1,000 or more in terms of polystyrene-equivalent molecular weight by gel permeation chromatography described below, wherein sulfur is contained in a component eluted within the above-described range. The sulfur atoms on the particle surfaces preferably have a bond energy peak top in the range of 166 to 172 eV measured by X-ray photoelectron spectrometry described below. In particular, the sulfur atoms preferably have a valence number of 4 or 6, and more preferably a valence number of 6. Regarding the bonding state of the sulfur atoms, sulfone, sulfonic acid, sulfonate, sulfuric ester, and sulfate ester are preferred. Sulfonic acid, sulfonate, sulfuric ester, and sulfuric ester, and sulfate ester are particularly preferred.

The toner of the preset invention preferably contains nitrogen atoms on the toner surface in addition to the sulfur atoms. The nitrogen atoms have a bond energy peak top in the range of 396 to 403 eV measured by X-ray photoelectron spectrometry described below. Moreover, the ratio of the content F of the nitrogen atoms on the toner surface to the content E of the sulfur atoms on the toner surface in terms atomic percent, i.e., the ratio F/E, preferably satisfies the relationship, $1 \leqq F/E \leqq 8$ measured by the X-ray photoelectron spectrometry described below. The nitrogen atoms in the toner of the present invention are preferably contained as amines or amides, and more preferably as amides.

When the above relationship is satisfied, the toner can exhibit good development characteristics and high transferability without being adversely affected by the environment and can provide high-quality images over a long term.

The sulfur-containing resin is essential for the toner of the present invention to exhibit sufficient development characteristics. In order to maximize the effect, sulfur atoms should be on the toner surface to best contribute to the toner charging. The inventors have also found that nitrogen atoms are desirable for the toner to maintain sufficient development characteristics in various operating environments. This is presumably because nitrogen atoms promote charging through unshared electron pairs at the initial stage of charging, but inhibit charging through interaction with sulfur atoms during overcharge, i.e., excess charge-up. At a ratio F/E less than 1, the effect of promoting charging is insufficient and the charge tends to be excessively low in high- and low-humidity environments. At a ratio F/E exceeding 8, the effect of the nitrogen atoms to inhibit charging becomes excessively strong, resulting in insufficient charging.

In order to control the ratio F/E, the percentage E and/or the percentage F can be adjusted as follows. The percentage E may be adjusted by changing the sulfur content in the sulfur-containing resin, changing the bonding state of the sulfur atoms, adjusting the amount of the sulfur-containing resin, or increasing the polarity of the sulfur-containing resin to be sufficiently higher than those of other materials. The percentage F may be adjusted by changing the nitrogen-containing functional groups in the nitrogen-containing substance, the amount of nitrogen, or the amount of the nitrogen-containing substance. The percentage F can also be controlled by increasing the polarity of the nitrogen-containing substance to be sufficiently higher than those of the other materials. Adjusting the percentage E or F as noted above can be done using conventional techniques known to the artisan.

The ratio F/E may be adjusted by controlling the sulfur atoms and nitrogen atoms contained in one compound, one monomer, and the like or may be adjusted by mixing other compounds, monomers, and the like.

More preferably, $2 \leqq F/E \leqq 6$ is satisfied.

In the present invention, the optimum range of the sulfur content of the toner particle surfaces can be defined by X-ray photoelectron spectrometry described below. In particular, the ratio of the sulfur content E on the toner particle surfaces to the carbon content A on the toner particles surfaces in terms of atomic percent measured by X-ray photoelectron spectrometry, i.e., the ratio E/A, is preferably in the range of 0.0003 to 0.0050. The ratio E/A can be controlled in the above-described range by adjusting the average particle diameter of iron oxides, the sulfur content in the binder resin, or the amount of the sulfur-containing monomer in accordance with conventional techniques. At a ratio less than 0.0003, the charge may be insufficient. At a ratio exceeding 0.0050, the charge becomes less dependent upon humidity.

The optimum range of the nitrogen content of the toner particle surfaces can also be defined by, for example, X-ray photoelectron spectrometry. The ratio of the nitrogen content F of the toner particle surfaces to the carbon content A on the toner particles surfaces in terms of atomic percent is preferably in the range of 0.0005 to 0.0100. At a ratio less than 0.0005, sufficient charge cannot be readily obtained. At a ratio exceeding 0.0100, the charge becomes less dependent upon humidity.

The ratio F/E, the ratio E/A, and the ratio F/A can be determined through surface composition analysis by X-ray photoelectron spectrometry, also known as electron spectroscopy for chemical analysis (ESCA). The apparatus used and the conditions employed in the ESCA are as follows:

Apparatus: X-ray photoelectron spectrometer 1600 S, manufactured by Physical Electronics Industries, Inc. (PHI)

Measuring conditions: MgKα (400 W) as X-ray source

Spectral region: 800 μmϕ

In calculating the atomic density at the surfaces, the intensity of the peak top in the bond energy range of 166 to 172 eV is used for sulfur, the intensity of the peak top in the bond energy range of 396 to 402 eV is used for nitrogen, and the intensity of the peak top in the bond energy range of 280 to 290 eV is used for carbon.

In this invention, the surface atomic density is calculated from the peak intensity of each element using relative sensitivity factors provided by PHI. Prior to measurement, the toner is preferably washed with ultrasonic sound to remove external additives from toner particle surfaces, isolated using a filter or the like, and dried.

Examples of the sulfur-containing monomer for making the sulfur-containing resin of the present invention include styrene sulfonic acid; 2-acrylamide-2-methylpropane sulfonic acid; 2-methacrylamide-2-methylpropane sulfonic acid; vinyl sulfonic acid; methacrylic sulfonic acid; and a maleic acid amide derivative, a maleimide derivative, and a styrene derivative having the following structures:

maleic acid amide derivative

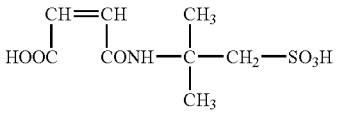

maleimide derivative

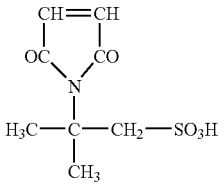

styrene derivative

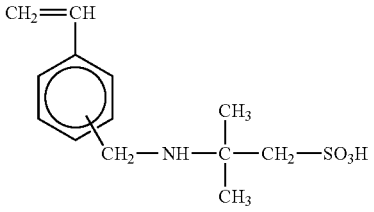

(Binding site is either ortho or para.)

The sulfur-containing resin of the present invention may be a homopolymer of any one of the monomers described above or a copolymer containing one of the above-described monomers and a separate monomer. Examples of the separate monomer that forms a copolymer with the above-described monomers include polymerizable vinyl monomers such as monofunctional polymerizable monomers and multifunctional polymerizable monomers.

Monomers containing sulfonic groups, in particular, (meth)acrylamide containing sulfonic groups, are preferred in order for the toner to obtain target circularity and average particle diameter.

The amount of the sulfur-containing monomer in the sulfur-containing resin of the present invention is preferably in the range of 0.01 to 20 percent by weight, more preferably 0.05 to 10 percent by weight, and most preferably 0.1 to 5 percent by weight based on the weight of the sulfur-containing resin in order to achieve target charge and target average circularity.

Examples of the aforementioned monofunctional polymerizable monomer include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acryl polymerizable monomers such as methyl acrylate, ethyl acrylate, n-propyl acrylate, isopropyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethylphosphate ethyl acrylate, diethylphosphate ethyl acrylate, dibutylphosphate ethyl acrylate, and 2-benzoyloxy ethyl acrylate; methacryl polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethyl hexyl methacrylate, n-octyl methacrylate, n-nonyl methacrylate, diethylphosphate ethyl methacrylate, and dibutylphosphate ethyl methacrylate; methylene aliphatic monocarboxylic ester; vinyl esters such as vinyl acetate, vinyl propionate, vinyl butyrate, vinyl benzoate, and vinyl formate; vinyl ethers such as vinylmethylether, vinylethylether, and vinylisobutylether; and vinyl ketones such as vinyl methyl ketone, vinyl hexyl ketone, and vinyl isopropyl ketone.

Examples of the multifunctional polymerizable monomer include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis-(4-acryloxy diethoxy)phenyl)propane, trimethylolpropane triacrylate, tetramethylolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxy diethoxy)phenyl)propane, 2,2'-bis(4-methacryloxy polyethoxy)phenyl)propane, trimethylolpropane trimethacrylate, tetramethylolmethane tetramethacrylate, divinylbenzene, divinylnaphthalene, and divinyl ether.

The sulfur-containing resin is preferably prepared by using the styrene derivative as the monomer among the above-described monomers. The sulfur-containing resin is preferably prepared by mass polymerization, solution polymerization, emulsion polymerization, suspension polymerization, ion polymerization, or the like. Solution polymerization is particularly preferred for its ease of operation.

The sulfur-containing resin containing sulfonic acid groups has the following structure:

$$X(SO_3^-)n \cdot mY^{k+}$$

wherein X represents a polymer moiety derived from the above-described polymerizable monomer, $Y^+$ represents a counter ion, k represents the valence number of the counter ion, m and n each represent an integer, and n is k×m. Preferable examples of the counter ion include a hydrogen ion, a sodium ion, a potassium ion, a calcium ion, and ammonium ion.

In the sulfur-containing resin, the acid number (mgKOH/g) of the polymer containing sulfonic acid groups is preferably in the range of 3 to 80, more preferably 5 to 40, and most preferably 10 to 30.

At an acid number less than 3, sufficient charge controlling effect cannot be obtained and environmental characteristics become poor. At an acid number exceeding 80, particles made by suspension polymerization using a composition containing such a polymer have irregular shapes, resulting in a decrease in circularity. Thus, the releasing agent appears on the toner particle surfaces, thereby degrading the development characteristics.

The amount of the sulfur-containing resin is preferably 0.05 to 20 parts by weight, and preferably 0.1 to 10 parts by weight per 100 parts by weight of the binder resin. At a content less than 0.05 part by weight, sufficient charge controlling effect can rarely be obtained; at a content exceeding 20 parts by weight, the average circularity decreases, and the developing and transfer properties become degraded. The content of the sulfur-containing resin in the toner can be determined by capillary electrophoresis or the like.

The weight-average molecular weight (Mw) of the sulfur-containing resin is preferably 2,000 to 10,000. At a weight average molecular weight less than 2,000, the flowability of the toner decreases and the transferability is degraded as a result. At a weight average molecular weight exceeding 10,000, the resin requires a longer time before becoming dissolved into the monomer, the dispersibility of the pigment decreases, and tinting power of the toner decreases.

The sulfur-containing resin preferably has a glass transition temperature (Tg) in the range of 50 to 100° C. At a glass transition temperature less than 50° C., the flowability, the storage stability, and the transferability of the toner are degraded. At a glass transition temperature exceeding 100° C., images cannot be sufficiently fixed when the area of toner printing is large.

The volatile content of the sulfur-containing resin is preferably in the range of 0.01 to 2.0% since a complex process for removing volatile-component is necessary to reduce the volatile content to less than 0.01% and insufficient charging, particularly, insufficient charging after the toner is left to stand for a certain period of time, results if the volatile content exceeds 2.0% in a high-temperature and high-humidity environment. The volatile content of the sulfur-containing resin here is calculated from a decrease in weight of the resin after an hour of heating at a high temperature (135° C.).

The method for extracting the sulfur-containing resin prior to measuring the molecular weight or the glass transition temperature of the sulfur-containing resin is not particularly limited. Any suitable method may be employed.

The average circularity of the toner of the present invention will now be explained.

The toner of the present invention preferably has an average circularity in the range of 0.950 to 0.995. A toner constituted from particles having an average circularity of 0.950 or more exhibits superior transferability. This is because the area of the contact between the toner particles and the photosensitive member is small, and the adhesive force of the toner particles to the photosensitive member resulting from image force, van der Waals force, or the like can thus be decreased. Accordingly, such a toner can exhibit high transfer efficiency while reducing the toner consumption.

Moreover, since toner particles having an average circularity of 0.950 or more have fewer edges on the surfaces and localization of charges within one particle rarely occurs, the charge distribution becomes narrower and a latent image can be faithfully developed. The average circularity is more preferably 0.960 or more. However, sufficient effects may not be obtained even when the average circularity is high if the circularity of predominant particles is low. Accordingly, the mode circularity, which will be described hereinafter, is preferably 0.99 or more. At a mode circularity of 0.99 or more, the predominant particles have a circularity of 0.99 and can yield sufficient effects.

On the other hand, a toner constituted from particles whose average circularity exceeds 0.995 can rarely suppress cleaning failure due to its high circularity.

In the present invention, the average circularity is used as a reference that can easily express the shape of particles in a quantitative manner. In the present invention, a flow particle image analyzer FPIA-2100 manufactured by Toa Iyo Denshi is used for measurement. The circularity $a_i$ of each of particles having an equivalent circle diameter of 3 μm or more is calculated from equation (1), and the sum of the circularity of particles is divided by the number m of particles to obtain the average circularity a, as shown by equation (2):

$$\text{Circularity } a_i = \frac{\text{Circumference of circle of equivalent area to projected particle image}}{\text{Perimeter of projected particle image}} \quad (1)$$

$$\text{Average circularity } a = \sum_{i-1}^{m} a_i / m \quad (2)$$

The circularities of individual particles measured are allotted to sixty-one circularity classes ranging from 0.40 to 1.00 at an interval of 0.01 to obtain a circularity frequency distribution. The circularity of the maximum frequency is defined as the "mode circularity".

In calculating the average circularity and the mode circularity, the image analyzer FPIA-1000 employed in the present invention employs a calculation method in which particles are classified into sixty-one circularity classes ranging from of 0.40 to 1.00 according to the circularity of individual particles measured, and the average circularity and the mode circularity are calculated using the medians and the frequencies of individual classes. This calculation method has a negligibly small margin of error in calculating the average circularity and the mode circularity. In the present invention, the measured circularities of individual particles are directly used in calculating the average and mode circularities according to the above-described process in order to simplify data handling, i.e., to decrease the time required for calculation and to simplify the operation expression.

The procedures for measurement are as follows. Dispersion liquid is prepared by dispersing 5 mg of a developer in 10 ml of an aqueous solution containing about 0.1 mg of a surfactant. The dispersion liquid is exposed to ultrasonic sound waves (20 kHz, 50 W) for five minutes to yield a dispersion liquid density of 5,000 to 20,000 particle/μl, followed by calculation of the average circularity and the mode circularity of a particle group having an equivalent circle diameter of at least 3 μm using the above-described analyzer.

In the present invention, the average circularity indicates the degree of surface irregularities of developer particles.

The circularity is 1.000 when a particle is perfectly spherical. The circularity decreases as the surface shape becomes irregular.

In the present invention, only the circularity of a particle group having an equivalent circle diameter of 3 μm or more is determined. This is because particles having an equivalent circle diameter of less than 3 μm contain large amounts particles of external additives independent of the toner particles and the circularity of the toner particles cannot be accurately determined due to these external additives.

The explanation of the toner particle diameter will now be presented.

The toner of the present invention must have a weight-average particle diameter D4 in the range of 3 to 10 μm in order to achieve higher image quality and to faithfully develop fine dots of latent images. The weight-average particle diameter D4 is more preferably in the range of 4 to 8 μm. A toner having D4 of less than 3 μm frequently remains in a large amount on the photosensitive member after transfer due to low transfer efficiency. Moreover, such a toner will cause wearing of the photosensitive member during the step of contact charging and obstruct control of the toner fusing. Since individual toner particles tend to be unevenly charged due to an increase in toner surface area and degradation of flowability and mixing characteristics, fogging and degradation of transferability occur, resulting in image blurring. Thus, such a toner is not suitable for the present invention. In contrast, a toner having D4 exceeding 10 μm easily spreads over characters or line images and thus rarely yields high resolution. A toner having D4 of 8 μm or more tends to exhibit lower reproducibility of individual dots as the resolution of the apparatus becomes higher.

The weight-average particle diameter and the number-average particle diameter of the toner of the present invention may be determined using a Coulter Counter TA-II or a Coulter Multisizer available from Coulter Corporation, or by employing various other methods. For example, the diameters may be determined as follows. An interface for outputting the particle number distribution and volume distribution, manufactured by Nikkaki Corporation, is connected to a personal computer PC9801 (manufactured by NEC Corporation). The electrolyte is a 1% NaCl aqueous solution prepared using primary sodium chloride. For example, ISOTON R-II manufactured by Coulter Scientific Japan can be used. The measurement is carried out as follows. To 100 to 150 ml of the electrolytic aqueous solution described above, 2 to 20 mg of a test sample is added. The electrolytic aqueous solution with suspended test sample is processed in a ultrasonic disperser for one to three minutes to disperse the test sample into the electrolytic aqueous solution. The volume and the number of toner particles having a diameter of 2 μm or more are determined with the above-described Coulter Multisizer using a 100-μm aperture to determine the volume distribution and the particle distribution. The weight-average particle diameter D4 is calculated based on the volume distribution of the particles within the range of the present invention, and the number-average particle diameter D1 is calculated from the particle distribution within the range of the present invention.

The toner particles of the present invention are preferably made by polymerization. The toner of the present invention may be made by pulverization, but toner particles made by pulverization generally have irregular shapes and require an additional process, such as a mechanical process or thermal process, to achieve an average circularity of 0.950 to 0.995 as required in the present invention. Thus, polymerization processes are preferred in making toner particles of the present invention.

Examples of the polymerization method for making toner particles include direct polymerization, suspension polymerization, emulsion polymerization, emulsion aggregation polymerization, and seed polymerization. Suspension polymerization is particularly preferred since the particle diameters can be well balanced with the particle shape. In suspension polymerization, a homogeneous polymer composition containing a polymerizable monomer and a coloring agent (a polymerization initiator, a crosslinking agent, a charge control agent, or other additives may be added if necessary) is prepared, and the monomer composition is dispersed into a continuous layer, e.g., a water phase, containing a dispersion stabilizer using a suitable stirrer to perform polymerization so as to obtain a toner having a desired particle diameter. The toner prepared by suspension polymerization, hereinafter referred to as the "polymer toner", consists of uniform spherical toner particles; thus, a toner having an average circularity of 0.950 to 0.995 and a mode circularity of at least 0.99 can be easily made by suspension polymerization. Since such a toner has relatively uniform charge distribution, it also achieves high transferability. If necessary, particles made by suspension polymerization may be blended with a polymerizable monomer and a polymerization initiator to prepare core-shell structure particles.

The toner of the present invention preferably contains 0.5 to 50 parts by weight of a releasing agent per 100 parts by weight of a binder resin. Examples of the binder resin include, as described below, various waxes.

The toner image transferred onto a recording medium is fixed onto the recording medium by application of energy, such as heat and/or pressure, to obtain a semipermanent image. A heat-roller fusing or thin-film belt fusing is frequently used for fixing toner images.

Toner particles having a weight-average particle diameter of 10 μm or less can produce superfine images but such fine toner particles become entrapped in gaps of fibers of the paper when paper is used as the recording medium. Accordingly, the toner particles cannot receive sufficient heat from the heat rollers, frequently resulting in low temperature offset. High resolution and resistance to offset can be simultaneously achieved by adding an adequate amount of releasing agent in the toner of the present invention.

Examples of the releasing agent suitable for the toner of the present invention include petroleum wax, such as paraffin wax, microcrystalline wax, and petrolatum, and derivatives thereof; montan wax and derivatives thereof; hydrocarbon wax prepared by a Fischer-Tropsch process and derivatives thereof; polyolefin wax, such as polyethylene, and derivatives thereof; and natural wax, such as carnauba wax and candelilla wax, and derivatives thereof. The derivatives include oxides, block copolymers with vinyl monomers, and graft conversion products. Further examples of the releasing agent include higher aliphatic alcohols; aliphatic acids such as stearic acid, and palmitinic acid, and compounds thereof; acid amide wax, ester wax, hydrogenated caster oil, and derivatives thereof; vegetable wax; and animal wax. Among these waxes, those having an endothermic peak in the range of 40 to 110° C. in differential thermal analysis are preferred, and those having an endothermic peak in the range of 45 to 90° C. are particularly preferred.

When the content of the releasing agent is less than 0.5 part by weight per 100 parts by weight of the binder resin, low-temperature offset cannot be sufficiently prevented. At a content exceeding 50 parts by weight, long-term storage ability is degraded, and other toner materials cannot be homogeneously dispersed. Moreover, the toner flowability and image quality are degraded.

The maximum endothermic peak temperature of the wax component is measured according to ASTM D 3418-8. For example, DSC-7 manufactured by PerkinElmer Inc. is used for measurement. The temperature correction at the detector unit is done using the melting points of indium and zinc. The calorie is adjusted using the temperature of the melting point of indium before actual measuring of the melting point so that a precise value can be measured. An aluminum pan is used to accommodate a sample, and an empty aluminum pan is prepared for comparison. The temperature is increased at a rate of 10° C./min.

The glass transition temperature (Tg) of the sulfur-containing resin is calculated from a differential scanning calorimetry (DSC) curve obtained during second heating. The glass transition temperature is determined as the intersection between the DSC curve and the median line between the base line before the endothermic peak and the base line after the endothermic peak.

The toner of the present invention must include a coloring agent in order to have tinting power. Preferable examples of the coloring agent of the present invention include the following organic pigment or dye.

Examples of cyan coloring agents include the following organic pigments and dyes: copper phthalocyanine compounds and derivatives thereof; anthraquinone compounds; and lake compounds of basic dyes thereof. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66.

Examples of magenta coloring agents include the following organic pigments and dyes: condensed azo compounds, diketopyrrolopyrrole compounds, anthraquinone, quinacridone compounds, lake compounds of basic dyes, naphthol compounds, benzimidazolone compounds, thioindigo compounds, and perylene compounds. Specific examples thereof include C.I. Pigment Red 2, C.I. Pigment Red 3, C.I. Pigment Red 5, C.I. Pigment Red 6, C.I. Pigment Red 7, C.I. Pigment Violet 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

Examples of yellow coloring agents include the following organic pigments and dyes: condensed azo compounds, isoindolinone compounds, anthraquinone compounds, azo metal complexes, methine compounds, and allylamide compounds. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194.

These coloring agents can be used alone or in combination. They may be used in the form of a solid solution. The coloring agent for use in the toner of the present invention is selected based on hue angle, color saturation, lightness, lightfastness, OHP transparency, and dispersibility into the toner. The amount of the coloring agent is preferably 1 to 20 parts by weight per 100 parts by weight of the binder resin.

Examples of black coloring agents include carbon black, magnetic material, and a material colored black by mixing the above-described yellow, magenta and cyan coloring agents. When the magnetic material is used as the black coloring agent, unlike other coloring agents, 30 to 200 parts by weight of the magnetic material is added per 100 parts by weight of the binder resin.

Examples of the magnetic material include oxides of iron, cobalt, nickel, copper, magnesium, manganese, aluminum, and silicon. Among these oxides, those containing iron oxide as the primary component, e.g., ferroso-ferric oxide, γ-iron oxide, and the like, are particularly preferred. Moreover, the magnetic material may additionally contain silicon, aluminum, or other metal elements. The BET specific surface area of magnetic particles determined by nitrogen adsorption measurement technique is preferably 2 to 30 $m^2/g$ and more preferably 3 to 28 $m^2/g$. The Mohs hardness of the magnetic particles is preferably 5 to 7.

The magnetic particles may be octahedral, hexahedral, spherical, spicular, squamous, or the like in shape. Among them, particles with low anisotropy, such as octahedral particles, hexahedral particles, spherical particles, and particles having no regular form, are preferred since such particles increase the image density. The average particle diameter of the magnetic material is preferably 0.05 to 1.0 μm, more preferably 0.1 to 0.6 μm, and most preferably 0.1 to 0.3 μm.

In the present invention, in order to prepare the toner by polymerization, particular attention must be paid to the polymerization inhibiting effect of the coloring agent and migration characteristics of the coloring agent to the water phase. Preferably, the coloring agent is surface-treated, e.g., subjected to hydrophobing with a material free of polymerization inhibiting effect, in advance. In particular, many dyes and carbon black, which have polymerization inhibiting effect, must be used with care. An example of the method for surface-treating dyes is a technique whereby a polymerizable monomer is polymerized in the presence of these dyes in advance, and the resulting colored polymer is added to the monomer system.

Carbon black may be treated as with the dyes described above, or may be treated with a material, e.g., polyorganosiloxane, which reacts with surface functional groups of the carbon black.

The method for making the toner of the present invention by suspension polymerization will now be described.

Examples of the polymerizable monomer used in the suspension polymerization of the present invention include styrene monomers such as styrene, o-methylstyrene, m-methylstyrene, p-methylstyrene, p-methoxystyrene, and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers of acrylonitrile, methacrylonitrile, acrylamide.

These monomers may be used alone or in combination. Styrene alone, a derivative of styrene alone, a combination of styrene and other monomers, and a combination of a derivative of styrene and other monomers are preferred to improve the development characteristics and durability.

The toner of the present invention may be polymerized by adding a resin to a monomer system. For example, monomers containing hydrophilic functional groups, such as amino groups, carboxylic groups, hydroxy groups, glycidyl groups, nitrile groups are water-soluble and cannot be used with an aqueous suspension since these monomers dissolve in the aqueous suspension and thus cause emulsion polymerization. In order to introduce such a monomer into the toner, the monomer may be copolymerized with styrene or a vinyl compound such as ethylene to form a copolymer, such as a random copolymer, a block copolymer, or a graft copolymer, and used. Alternatively, the monomers containing hydrophilic functional groups may be used in the form of polycondensates, such as polyester or polyamide, or polyaddition polymers, such as polyether or polyimine. When such a high-molecular-weight polymer containing polar functional groups is contained in the toner, the above-described wax component can be phase-separated and achieves stronger encapsulation. As a result, a toner having high resistance to offset, high resistance to blocking, and a superior low-temperature fixing property can be obtained.

In order to improve the dispersibility, the fixing property, or the image characteristics of the material, a resin other than those described above may be added to the monomer system. Examples of such an additional resin include monomers of substituted or unsubstituted styrenes, such as polystyrene and polyvinyltoluene; styrene copolymers such as styrene-propylene copolymers, styrene-vinyltoluene copolymers, styrene vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinylmethylether copolymers, styrene-vinylethylether copolymers, styrene-vinylmethylketone copolymer, styrene-butadiene copolymer, styrene-isoprene copolymer, styrene-maleic acid copolymer, and styrene-maleic acid ester copolymers; polymethylmethacrylate; polybutylmethacrylate; polyvinyl acetate; polyethylene; polypropylene; polyvinylbutyral; silicone resin; polyester resin; polyamide resin; epoxy resin; polyacrylate resin; rosin; modified rosin; terpene resin; phenol resin; aliphatic or alicyclic hydrocarbon resin; and aromatic petroleum resin. These may be used alone or in combination.

The content of these resins is preferably 1 to 20 parts by weight per 100 parts by weight of the monomer. At a resin content less than 1 part by weight, sufficient effect cannot be obtained; at a resin content exceeding 20 parts by weight, controlling the physical properties of the polymer toner becomes difficult.

An additional monomer having a molecular weight outside the molecular weight range of the polymer toner may be dissolved in the above-described monomer when conducting polymerization. In this manner, a toner having a wide molecular weight distribution and high resistance to offset can be obtained.

The toner of the present invention is preferably polymerized using a polymerization initiator having a half life of 0.5 to 30 hours during the polymerization reaction. The amount of the polymerization initiator is preferably 0.5 to 20 parts by weight per 100 parts by weight of the polymerizable monomer. In this manner, a polymer having a local maximum in the molecular weight range of 10,000 to 100,000 can be obtained by the polymerization, and a toner having a desired strength and adequate melting characteristics can be prepared. Examples of the polymerization initiator include azo or diazo polymerization initiators such as 2-2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide polymerization initiators such as benzoyl peroxide, t-butyl peroxy 2-ethylhexanoate, t-butyl peroxy pivalate, t-butyl peroxy isobutylate, t-butyl peroxy neodecanoate, methylethylketone peroxide, diisopropyl peroxy carbonate, cumene hydroperoxy peroxide, 2,4-dicyclobenzoyl peroxide, and lauroyl peroxide.

The polymer toner of the present invention may be prepared using a crosslinking agent. The amount of the crosslinking agent is preferably 0.001 to 15 percent by weight.

A molecular weight modifier may be used in making the polymer toner of the present invention. Examples of the molecular weight modifier include mercaptans such as t-dodecyl mercaptan, n-dodecyl mercaptan, and n-octyl mercaptan; halohydrocarbons such as carbon tetrachloride and carbon tetrabromide; and α-methyl styrene dimer. These molecular weight modifiers may be added before of during polymerization. The amount of the molecular weight modifier is preferably 0.01 to 10 parts by weight and preferably 0.1 to 5 parts by weight relative to 100 parts by weight of the polymerizable monomer.

In the method for making the polymer toner of the present invention, a monomer system is suspended in an aqueous medium containing a dispersion stabilizer. Here, the monomer system is prepared by mixing the above-described toner composition, i.e., the polymerizable monomer, with the polymer having sulfonic acid groups, magnetic powder, a releasing agent, a plasticizer, a charge control agent, a crosslinking agent, a component required in the toner, such as a coloring agent (optional), and various other additives, such as an organic solvent for decreasing the viscosity of the polymer synthesized by the polymerization, a high molecular weight polymer, and a dispersant, to prepare a mixture, and homogenously dissolving and dispersing the mixture with a dispersing apparatus such as a homogenizer, a ball mill, a colloid mill, or an ultrasonic dispersing apparatus. A high-speed dispersing apparatus, such as a high-speed stirrer or an ultrasonic dispersing apparatus, is preferably used to rapidly obtain toner particles of desired size since toner particles prepared in such a manner have a sharp particle diameter distribution. The polymerization initiator may be added into the polymerizable monomer at the same time with other additives or may be added immediately before suspending the polymerizable monomer in the aqueous medium. Moreover, the polymerization initiator, dissolved in a polymerizable monomer or a solvent, may be added to the system immediately after formation of particles before initiating the polymerization reaction. After formation of particles, a normal stirrer may be used to maintain the state of the particle and to prevent the particles from floating and settling.

In preparing the polymer toner of the present invention, a known surfactant, an organic dispersant, or an inorganic dispersant may be used as the dispersion stabilizer. Organic dispersants are particularly preferred since they rarely produce hazardous superfine particles, have superior stability against changes in reaction temperature due to steric hindrance, and cause no adverse effects on the toner since they can be easily removed by washing. Examples of the inorganic dispersant include phosphates of multivalent metals such as calcium phosphate, magnesium phosphate, aluminum phosphate, and zinc phosphate; carbonates such as calcium carbonate and magnesium carbonate; inorganic salts such as calcium metasilicate, calcium sulfate, and barium sulfate; inorganic oxides such as calcium hydroxide, magnesium hydroxide, aluminum hydroxide, silica, bentonite, and alumina.

The inorganic dispersant may be used alone in an amount of 0.2 to 20 parts by weight relative to 100 parts by weight of the polymerizable monomer. Moreover, 0.001 to 0.1 part by weight of a surfactant may be used to control the particle size distribution. Examples of the surfactant include sodium dodecyl benzene sulfate, sodium tetradecyl sulfate, sodium pentadecyl sulfate, sodium octyl sulfate, sodium oleate, sodium laurate, sodium stearate, and potassium stearate.

The inorganic dispersant may be directly used or may be processed into finer inorganic dispersant particles in an aqueous medium. In using calcium phosphate as the dispersant, aqueous sodium phosphate is mixed with aqueous calcium chloride under high-speed stirring to synthesize water-insoluble calcium phosphate, which can be more homogeneously and finely dispersed into the medium. Although the water-soluble salt of sodium chloride is produced at the same time, the presence of water-soluble salts in the aqueous medium inhibits the polymerizable monomer from dissolving into water. As a result, emulsion polymerization that produces ultrafine toner particles is suppressed, which is favorable to the present invention. The water medium produces adverse effects in removing the unreacted polymerizable monomer at the end of the polymerization reaction; thus, the aqueous medium should be replaced or desalinated with an ion-exchange resin. The inorganic dispersant can be substantially completely removed by dissolving with acid or alkali after termination of the polymerization reaction.

In the polymerization process described above, the polymerization temperature is controlled to be at least 40° C. and normally within the range of 50 to 90° C. Polymerization at such a temperature promotes precipitation of the releasing agent and wax as a result of phase separation so that the encapsulation of these materials becomes more complete. The reaction temperature may be increased to a temperature in the range of 90° C. to 150° C. during the later period of the polymerization in order to consume the remaining polymerizable monomer. The polymer toner particles after polymerization are filtered, washed, and dried by known processes, and mixed with inorganic fine powder so that the inorganic fine powder adheres onto the particle surfaces to prepare a toner. A classification step may be added to the process in order to remove coarse particles and fine particles.

The toner of the present invention may be made by a known pulverization process. For example, a binder resin, a sulfur-containing polymer, magnetic powder, a releasing agent, a charge control agent, a toner component, such as a coloring agent (optional), and other suitable additives are processed in a mixer, such as a Henschel mixer or a ball mill, to prepare a homogeneous mixture. The mixture is melt-kneaded with a kneader such as a heat roller, a kneader, or an extruder to disperse or dissolve the magnetic powder and other toner materials into the molten resins. The molten resins are solidified by cooling, pulverized, classified, and surface-treated, if necessary, to prepare toner particles. If necessary, fine particles and the like may be added to obtain the toner of the present invention. The classification may be performed before or after surface treatment. In the classification step, a multistage classifier is preferably used to increase the production efficiency. In the pulverizing step, a known mill, such as a mechanical impact mill or a jet mill, may be used. In order to prepare a toner having a particular circularity according to the present invention, particles are preferably milled with heating or subjected to an auxiliary process of applying mechanical impacts. Moreover, pulverized fine toner particles, which may be classified if necessary, may be dispersed into hot water (hot water bath method) or may be passed through a hot air stream.

Examples of means for applying mechanical impacts to the particles include a method using a mechanical impact mill such as Kryptron system manufactured by Kawasaki Heavy Industries, Ltd., or a Turbo Mill manufactured by Turbo Kogyo Co., Ltd.; and a method using a mechanofusion system manufactured by Hosokawa Micron Corporation, a hybridization system manufactured by Nara Machinery Co., Ltd., or the like whereby mechanical impacts are applied to the toner by compression force, frictional force, and the like produced by compressing the toner particles against the interior of the casing of such a system through centrifugal force produced by blades rotating at high speeds.

In applying mechanical impacts, the processing temperature is preferably near the glass transition temperature Tg of the toner, in particular, in the range of Tg ±10° C., to prevent aggregation and increase productivity. More preferably, the processing temperature is within the range of Tg ±5° C. to increase the transfer efficiency.

Alternatively, the toner of the present invention may be prepared by the method disclosed in Japanese Patent Publication No. 56-13945, by a dispersion polymerization method or an emulsion polymerization method. In the method disclosed in Japanese Patent Publication No. 56-13945, a melt-blended material is atomized in air using a disk or a multi-fluid nozzle to obtain spherical toner particles. Examples of the emulsion polymerization method include a dispersion polymerization method in which an aqueous organic solvent, which is soluble in the monomer but insoluble in the resulting polymer, is used to directly synthesize toner particles, and a soap-free polymerization method in which the monomer is directly polymerized into toner particles in the presence of a water-soluble polar polymerization initiator.

Examples of the binder resin used in preparing the toner of the present invention by pulverization include homopolymers of substituted or unsubstituted styrenes, such as polystyrene and polyvinyltoluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinylmethylether copolymer, styrene-vinylethylether copolymer, styrene-vinyl methyl ketone copolymer, styrene-butadiene copolymer, styrene-isoprene copolymer, styrene-maleic acid copolymer, and styrene-maleic acid ester copolymer; polymethylmethacrylate; polybutylmethacrylate; polyvinyl acetate; polyethylene; polypropylene; polyvinyl butyral; silicone resin; polyester resin; polyamide resin; epoxy resin; polyacrylic resin; rosin; modified rosin; terpene resin; phenol resin; aliphatic or alicyclic hydrocarbon resin; and aromatic petroleum resin. These resins may be used alone or in combination. Styrene copolymers and polyester resin are particularly preferred to improve development characteristics and fixability.

In the toner of the present invention, a charge control agent may be blended with the toner particles. In this manner, frictional charge can be optimized according to the development system.

The toner of the present invention preferably contains a plasticizer composed of an inorganic fine powder having an average primary particle diameter of 4 to 80 nm to improve the flowability. The amount of the plasticizer is preferably 0.1 to 4 percent by weight relative to the entirety of the toner. The inorganic fine powder improves the flowability of the toner and contributes to uniform charging of toner particles. The inorganic fine powder may be given additional functions, such as controlling the charge of the toner and increasing the resistance to the environment, through a hydrophobizing treatment or the like.

An inorganic fine powder having an average primary particle diameter exceeding 80 nm cannot yield sufficient toner flowability. As a result, charging of the toner particles becomes uneven, resulting in nonuniform frictional charging in a low-humidity atmosphere, an increase in fogging, a decrease in image density, and degradation of durability. With an inorganic fine powder having an average primary particles less than 4 nm, aggregation force between inorganic fine particles increases; thus, the inorganic fine powder rarely exists in the form of primary particles. Instead, the inorganic fine powder forms aggregates, which are hard to disintegrate, and exhibits a wide particle size distribution. Development using such aggregates will result in image failure due to damage done to the image-carrying member and the toner-carrying member by such aggregates. The average primary particle diameter of the inorganic fine powder is preferably 6 to 35 nm to uniformly charge the toner particles.

The average primary particle diameter of the inorganic powder may be determined by examining 100 or more primary particles attached to or separated from the toner particle surfaces and calculating the number-average particle diameter from the examination. In particular, the diameter of individual primary particles is determined from an enlarged micrograph taken using a scanning electron microscope (SEM) while referring to a toner photograph, in which elements contained in the inorganic fine powder are marked by an elemental analyzer, such as XMA of the SEM.

The amount of the inorganic fine powder can be determined with a fluorescent X-ray analyzer using calibration curves obtained from standard samples.

Examples of the inorganic fine powder added to the toner of the present invention include powders of silica, titanium oxide, alumina, or complex oxide thereof.

Either dry-process silica (also known as fumed silica), prepared by vapor-phase oxidation of silicon halides, or wet-process silica prepared from water glass or the like may be used as the silica. Dry-process silica is preferred since it has fewer silanol groups on the surface and in the interior of the silica fine particles and contains small amounts of the synthetic residues, such as $Na_2O$ and $SO_3^{2-}$. During the course of synthesizing dry silica, a metal halide compound, such as aluminum chloride or titanium chloride, can be used in combination with silicon halide to prepare a complex powder of silica and metal oxide. Such dry silica may also be used in the present invention.

Preferably, 0.1 to 4.0 parts by weight of the inorganic fine particles having an average primary particle diameter of 4 to 80 nm are contained per 100 parts by weight of toner matrix particles. The content of the inorganic fine particles must be at least 0.1 part by weight to exhibit sufficient effects but must not exceed 4.0 parts by weight to avoid degradation of the fixability.

The inorganic fine particles are preferably subjected to hydrophobizing in order to improve the properties in a high-humidity environment. When the inorganic fine particles contained in the toner absorb moisture, the charge of the toner drastically decreases, thereby degrading the development characteristics and fixability of the toner.

Examples of hydrophobizing agents include silicone varnish, modified silicone varnishes, silicone oil, modified silicone oils, silane compounds, silane coupling agents, other organic silicon compounds, and organic titanium compounds. These agents may be used alone or in combination.

The inorganic fine particles are preferably treated with silicone oil. More preferably, the inorganic fine particles are be treated with silicone oil during or after the hydrophobizing process since the toner containing such inorganic fine particles maintains high charge in a high-humidity environment and reduces the occurrence of selective development.

For example, the inorganic fine powder may be silylated to eliminate active hydrocarbon groups on the surface through chemical bonding (first stage reaction) and then treated with silicone oil to form a hydrophobic thin coating on the particle surfaces (second stage reaction). Here, 5 to 50 parts by weight of a silylating agent is preferably used per 100 parts by weight of the inorganic fine powder. At an amount less than 5 parts by weight, active hydrocarbon groups on the particle surfaces of the inorganic fine powder cannot be sufficiently eliminated. At an amount exceeding 50 parts by weight, aggregation of the inorganic particles occur through siloxane compounds produced by the reaction of the excess silylating agent, the siloxane compounds acting as a binder, thereby causing image defects.

The silicone oil preferably has a viscosity of 10 to 200,000 $mm^2/s$, and more preferably 3,000 to 80,000 $mm^2/s$. At a viscosity less than 10 $mm^2/s$, the inorganic fine powder exhibits insufficient stability and may degrade image quality when heat or mechanical stress is applied. At a viscosity exceeding 200,000 $mm^2/s$, the particles may not be uniformly treated.

The inorganic fine powder may be treated with silicone oil by directly mixing silicone oil into the inorganic fine powder treated with a silane compound or by spraying silicone oil toward the inorganic fine powder. Alternatively, the inorganic fine powder may be added to silicone oil dispersion or dissolution prepared in advance, followed by removal of the medium. The spraying method is preferred since the method produces a smaller amount of aggregates of inorganic fine particles.

The amount of the silicone oil used is preferably 1 to 23, and more preferably 5 to 20 parts by weight per 100 parts by weight of the inorganic fine powder. When the amount of the silicone oil is excessively small, sufficient hydrophobic property cannot be achieved. When the amount of the silicone oil is excessively large, aggregation of the inorganic fine particles frequently occurs.

The toner of the present invention may further contain organic or inorganic nearly spherical fine particles having a primary particle diameter exceeding 30 nm (preferably having a specific surface area less than 50 $m^2/g$) and more preferably 50 nm or more (preferably having a specific surface area less than 30 $m^2/g$) so that the toner can be easily removed from the photosensitive member during the cleaning step. Preferable examples of such particles include spherical silica particles, spherical polymethyl silsesquioxane particles, and spherical resin particles.

The toner of the present invention may contain other additives as long as the additives do not have adverse effects on the invention. Examples of the additives include lubricant powders such as Teflon (registered trademark) powder, zinc stearate powder, and polyvinylidene fluoride powder; polishing agents such as cerium oxide powder, silicon carbide powder, and strontium titanate powder; plasticizers such as titanium oxide powder and aluminum oxide powder; caking-prevention agents; and development improvers such as reversed-polarity organic and inorganic fine particles. These additives may be subjected to hydrophobizing in advance.

When silica is used as the inorganic fine powder of the present invention, the percentage of free silica, i.e., silica particles detached from the surfaces of the toner particles, is preferably in the range of 0.05% to 10.0%, and more preferably 0.1% to 5.0% based on the total weight of silica particles detached from the surfaces of the toner particles and silica particles attached to the surfaces of the toner particles. The percentage of free silica can be determined with a particle analyzer described below using the following equation:

$$\text{Percentage of free silica} = 100 \times \frac{Ns}{Nc + Ns} \tag{3}$$

wherein Ns represents the number of emissions from only silicon atoms, and Nc represents the number of synchronized emissions from silicon atoms and carbon atoms.

In particular, emission from carbon atoms may be measured in channel 1 and emission from silicon atoms may be measured in channel 2 (measuring wavelength: 288.160 nm, K factor: recommended value).

According to the investigations of the inventors, fogging and roughening increase during the later stage of a multi-time printing test in a high-temperature and high-humidity environment when the percentage of the free silica is less than 0.05%. In general, external additives tend to become incorporated into the toner particles by the stress from regulating members and the like in a high-temperature environment, and thus the flowability of the toner decreases after many cycles of printing, thereby causing the problem described above. At a percentage of free silica of 0.05% or more, this problem rarely occurs. This is presumably because the presence of such an amount of free silica improves flowability of the toner, and silica particles do not become easily incorporated by stresses. Even when incorporation of the silica particles that exist on the particles surfaces occur due to stresses, free silica particles will adhere onto the surfaces of the toner particles to prevent a decrease in flowability.

On the other hand, when the percentage of free silica exceeds 10.0%, free silica particles contaminate the charge regulating members and cause extensive fogging, which is problem. In such a case, the toner particles cannot be uniformly charged, and cleaning failure may result. Thus, the percentage of free silica must be controlled within 0.05% to 10.0%. The percentage of free silica can be determined from an emission spectrum obtained by introducing the toner into a plasma. The percentage of the free silica is determined from the equation described above from the synchronized emission of carbon atoms, which are the constituent element of the binder resin, and silicon atoms.

Here, "synchronized emission" means emission from silicon atoms occurring within 2.6 msec from emission from carbon atoms. Emission from silicon atoms occurring thereafter is referred to as the "emission from only silicon atoms".

The fact that emission from carbon occurs synchronously with emission from silicon indicates that the toner particles contain silica powder. Emission from only silicon atoms indicates the presence of silica particles detached from the toner particles.

The percentage of free silicon atoms can be measured by the principle set forth in pages 65 to 68 of Japan Hardcopy '97 Ronbunshu. The measurement is preferably carried out with a particle analyzer PT1000, manufactured by Yokogawa Electric Corporation. In particular, fine particles of toner are introduced one by one into a plasma to obtain a spectrum. From the obtained spectra, elements constituting the light-emitting material can be identified, and the number and diameter of the particles can be determined.

The specific method for measuring the percentage of free silica particles using the above-described analyzer is as follows. The measurement is taken in helium gas containing 0.1% of oxygen at 23° C. and a humidity of 60%. A toner sample is left to stand in the same environment over night to control the humidity. Carbon atoms are measured via channel 1 (measuring wavelength: 247.860 nm, K factor: recommended value) and silicon atoms are measured via channel 2 (measuring wavelength: 288.160 nm, K factor: recommended value). Sampling is performed so that the number of emission from the carbon atoms is in the range of 1,000 to 1,400 for each scanning. Scanning is repeated until the total number of emission from carbon atoms reached 10,000 or more. The number of emission is accumulated. In a distribution in which the number of emissions from carbon atoms is indicated in the ordinate and the triple-root voltage of carbon atoms is indicated in the abscissa, sampling is done to yield a distribution having only one local maximum and thus no valley. Based on the obtained data, the noise cut level of all elements is set to 1.50 V, and the percentage of free silica, i.e., silicon atoms, is calculated from the above-described equation.

In this invention, the percentage of free silica may be changed according to the type and amount of the external additives used. Moreover, the percentage of free silica may be controlled by adjusting the adhesiveness of the external additives to the toner particles, such as by changing the conditions of stirring for blending the external additives. In short, the percentage of free silica particles can be decreased by increasing the adhesion of the external additives to the toner particles or by decreasing the amount of external additives.

The method and the system for forming images according to the present invention will now be described with reference to the drawings.

In the development step of the image forming method of the present invention, a toner supporting member is preferably in contact with the surface of a photosensitive member, i.e., a latent image carrying member.

The toner supporting member may be an elastic roller. For example, the surface of the elastic roller is coated with the toner, and is put into contact with the surface of the photosensitive member. The latent image is developed through an electric field generated between the photosensitive member and the elastic roller pressed against the surface of the photosensitive member via the toner. Thus, the surface or the region near surface of the elastic roller must have a particular electric potential in order to produce an electric field in a narrow gap between the surface of the photosensitive member and the surface of the toner-carrying member. The resistance of the elastic rubber of the elastic roller may be controlled within the intermediate resistance region so as to prevent conduction with the photosensitive member surface while maintaining the electric field; alternatively, a conductive roller having a thin insulating film on the surface may also be used. Moreover, a conductive resin sleeve constituted from a conductive roller, the side opposing the photosensitive member of which is provided with an insulating coating, or an insulating sleeve, the side remote from the photosensitive member of which is provided with a conductive coating, may also be used. A system including a rigid roller as the toner supporting member, and an elastic component as the photosensitive member may also be employed. An example of the elastic component is a belt. The resistance of the development roller (the toner supporting member) is preferably in the range of $10^2$ to $10^9$ Ω·cm.

The surface roughness Ra (μm) of the toner supporting member is preferably in the range of 0.2 to 3.0 μm to achieve both high image quality and high durability. The surface roughness Ra is strongly related to toner transferring capacity and toner charging capacity. At a surface roughness Ra exceeding 3.0 μm, the toner on the toner-carrying member rarely forms a thin layer, and electrostatic property of the toner does not improve. Accordingly, the image quality does not improve. The surface roughness should be 3.0 μm or less to decrease the toner transfer capacity of the toner supporting member and to reduce the thickness of the toner layer on the toner supporting member. In this manner, the toner supporting member comes into contact with the toner more frequently, thereby improving the electrostatic property of the toner and improving the image quality. When the surface roughness Ra is less than 0.2 μm, control of the toner coat thickness becomes difficult.

In the present invention, the surface roughness Ra of the toner supporting member is measured according to Japanese Industrial Standards (JIS) B 0601. The surface roughness Ra is the centerline average roughness measured using a surface roughness tester Surfcorder SE-30H manufactured by Kosaka Laboratory, Ltd. In particular, a segment having a measurement length a, i.e., 2.5 mm, is extracted in the centerline direction from a roughness curve; the centerline of the segment is defined as the X axis, the direction of the longitudinal magnification is defined as the Y axis, and the roughness curve is defined as y=f(x); and the surface roughness (μm) is calculated from the following equation:

$$Ra=\int_0^a|f(x)|dx\times 1/a \quad (4)$$

In the image forming method of the present invention, the rotation direction of toner supporting member may be the same as or opposite to the rotation direction of the photosensitive member. When the rotation direction is the same, the peripheral speed of the toner supporting member is preferably 1.05 to 3.0 times that of the photosensitive member.

At a peripheral speed of the toner supporting member of less than 1.05 times the peripheral speed of the photosensitive member, the toner on the photosensitive member cannot be sufficiently agitated, and image quality cannot be improved. At a peripheral speed exceeding 3.0 times that of the photosensitive member, deterioration of the toner due to mechanical stresses and adhesion of the toner onto the toner supporting member occur.

A photosensitive drum or belt having a photoconductive insulating layer composed of amorphous selenium, CdS, $ZnO_2$, organic photoconductive compounds (OPC), amorphous silicon, or the like is preferably used as the photosensitive member. The binder resin contained in the organic photosensitive layer of the OPC photosensitive member is not limited, but is preferably a polycarbonate resin, a polyester resin, or an acrylic resin since such resins have excellent transferability and prevent melt-bonding of the toner to the photosensitive member and filming of the external additives.

The method for forming images according to the present invention will now be described with reference to the attached drawings.

FIG. 1 shows an image forming system including a development unit 100, a photosensitive member 109, a recording medium, such as paper, 105, a transfer member 106, a fixing pressure roller 107, a fixing heat roller 108, and a primary charging member 110 making contact with the photosensitive member 109 to directly charge particles.

The primary charging member 110 is connected to a bias supply 115 for uniformly charging the surface of the photosensitive member 109.

The development unit 100 contains a toner 104 and has a toner supporting member 102 rotating in the direction of the arrow while making contact with the photosensitive member 109. The development unit 100 also has a development blade 101 for regulating the amount of toner and supplying charges and an application roller 103 rotating in the direction of the arrow. The application roller 103 delivers the toner 104 onto the toner supporting member 102 and supplies charges to the toner by the frictional force generated between the toner supporting member 102 and the application roller 103. The toner supporting member 102 is connected to the development bias supply 117. The application roller 103 is connected to another bias supply (not shown) so that the voltage is set to the negative side when a negative toner is used and set to the positive side when a positive toner is used, with respect to the development bias.

The transfer member 106 is connected to a transfer bias supply 116 having a polarity opposite to that of the photosensitive member 109.

The distance in the rotation direction between the photosensitive member 109 and the toner supporting member 102 at the contact region, i.e., the development nip width, is preferably in the range of 0.2 mm to 8.0 mm. A width less than 0.2 mm results in insufficient development, insufficient image density, and poor residual toner recovery. A width exceeding 8.0 mm may result in excess supply of toner, extensive fogging, and accelerated wear of the photosensitive member.

The toner supporting member 102 is preferably an elastic roller including having an elastic layer on the surface. The hardness of the material of the elastic layer is preferably 30 to 60 degrees (Asker-C/1 kg load) as measured by Japanese Industrial Standard (JIS) K 6050.

The resistivity of the toner supporting member 102 is preferably in the range of $10^2$ to $10^9$ Ωcm in terms of volume resistivity. At a resistivity less than $10^2$ Ωcm, e.g., when the surface of the photosensitive member 109 has pinholes and the like, overcurrent may occur. At a resistivity less than $10^9$ Ωcm, excess charge-buildup of the toner occurs due to frictional electrification, thereby causing a decrease in image density.

The amount of the toner coating the toner supporting member 102 is preferably in the range of 0.1 to 1.5 mg/cm$^2$. At an amount less than 0.1 mg/cm$^2$, the image density is insufficient; at an amount exceeding 1.5 mg/cm$^2$, the toner particles are rarely uniformly electrified, resulting in increased fogging. More preferably, the amount of the coating toner is in the range of 0.2 to 0.9 mg/cm$^2$.

The amount of the coating toner is regulated using the development blade 101. The development blade 101 is in contact with the toner supporting member 102 via the coating toner. The contact pressure between the development blade 101 and the toner supporting member 102 is preferably 4.9 to 49 N/m (5 to 50 gf/cm). At a contact pressure less than 4.9 N/m, the amount of the coating toner becomes difficult to control, and the particles are rarely uniformly electrified by friction, resulting in increased fogging. At a contact pressure exceeding 49 N/m, an excess load is applied to the toner particles, resulting in particle deformation and melt-bonding of the toner particles onto the development blade 101 or the toner supporting member 102.

The free end of the member, such as the development blade 101, for regulating the amount of the coating toner, may have any shape as long as the NE-length, i.e., the length of the development blade 101 from the point abutting the toner supporting member 102 to the free end, is within a predetermined range. For example, a blade having a linear cross-section, a blade having a letter-L shape, or a blade with a spherically bulged end may be employed.

The member for regulating the amount of the coating toner may be an elastic blade that can apply the toner by pressure, or may be a rigid metal blade.

When the regulating member is elastic, the member is preferably composed of a material capable of frictional electrification suitable for electrifying the toner to a desired polarity. Examples of such a material include elastic rubbers such as silicone rubbers, urethane rubbers, acrylonitrile butadiene rubbers (NBRs); synthetic resins such as polyethylene terephthalate; an elastic metal such as stainless steel, steel, and phosphor bronze. These materials may be used alone or in combination.

When both elastic regulating member and the toner supporting member are required to have high durability, an elastic metal member bonded with a resin or rubber or an elastic metal member coated with a resin or rubber can be used as the elastic regulating member.

An organic or inorganic material may be added to the material of the elastic regulating member through melt-blending or dispersion. For example, the electrification property of the toner can be controlled by adding metal oxide, metal powder, ceramic, a carbon allotrope, whiskers, inorganic fibers, dye, pigment, a surfactant, and the like. In particular, when the elastic member is composed of rubber or resin, metal oxide fine powders of silica, alumina, titania, tin oxide, zirconium oxide, zinc oxide, and the like, carbon black, and a charge control agent commonly used with toners are preferably contained.

Application of a DC field and/or an AC field to the regulating member evens out the toner. As a result, the toner can be uniformly applied to form a thin layer and can be uniformly electrified; moreover, sufficient image density and image quality can be achieved.

In the system shown in FIG. 1, the primary charging member 110 uniformly charges the photosensitive member 109 rotating in the arrow direction. The primary charging member 110 is basically constituted from a core 110*b* and a conductive elastic layer 110*a* that surrounds the core 110*b*. The primary charging member 110, i.e., the charging roller, is pressed against one side of the photosensitive member, i.e., electrostatic latent image carrying member, 109 at a predetermined pressure and is driven by the rotation of the photosensitive member 109.

The charging roller is preferably used at an abutting pressure of 4.9 to 490 N/m (5 to 500 gf/cm). The applied voltage is preferably DC voltage or DC voltage superimposed with AC. In the present invention, the applied voltage is preferably DC voltage in the range of ±0.2 to ±5 kV.

Examples of other electrification means include charging blades and conductive brushes. These charging means are of a contact type and have advantages over noncontact corona charging since the contact type charging means do not require high voltage and therefore reduce generation of ozone. Contact-type charging rollers and blades are preferably composed of conductive rubber and may be provided with releasing films on the surfaces. Releasing films may be made of nylon resins, polyvinylidene fluoride (PVDF), polyvinylidene chloride (PVDC), and the like.

Upon completion of the primary charging, an electrostatic latent image corresponding to an information signal is formed on the photosensitive member 109 through exposing light 123 emitted from a light-emitting device. The electrostatic latent image is developed and visualized with the toner at a region where the toner supporting member 102 abuts the photosensitive member 109. Since the image forming method of the present invention employs a development system in which a digital latent image is formed on the photosensitive member, the latent image is prevented from being disarranged and dots of the latent image can be faithfully developed. The exposed image is transferred onto the recording medium 105 by the transfer member 106 and passes through the gap between the fixing heat roller 108 and the fixing pressure roller 107 to form a permanent fixed image. Although a heat roller system employing a heat roller with a heater such as a halogen heater and an elastic pressure roller pressed against the heat roller is employed in the system shown in FIG. 1, other fixing means, e.g., a system in which image is thermally fixed using a heater via films, may be employed.

The residual toner remaining on the photosensitive member 109 without being transferred is recovered and the photosensitive member 109 is cleaned using a cleaner 138 having a cleaning blade abutting against the photosensitive member 109.

An image forming method using the toner of the present invention and an apparatus unit used in the method will now be described with reference to the drawings.

Figure 2:
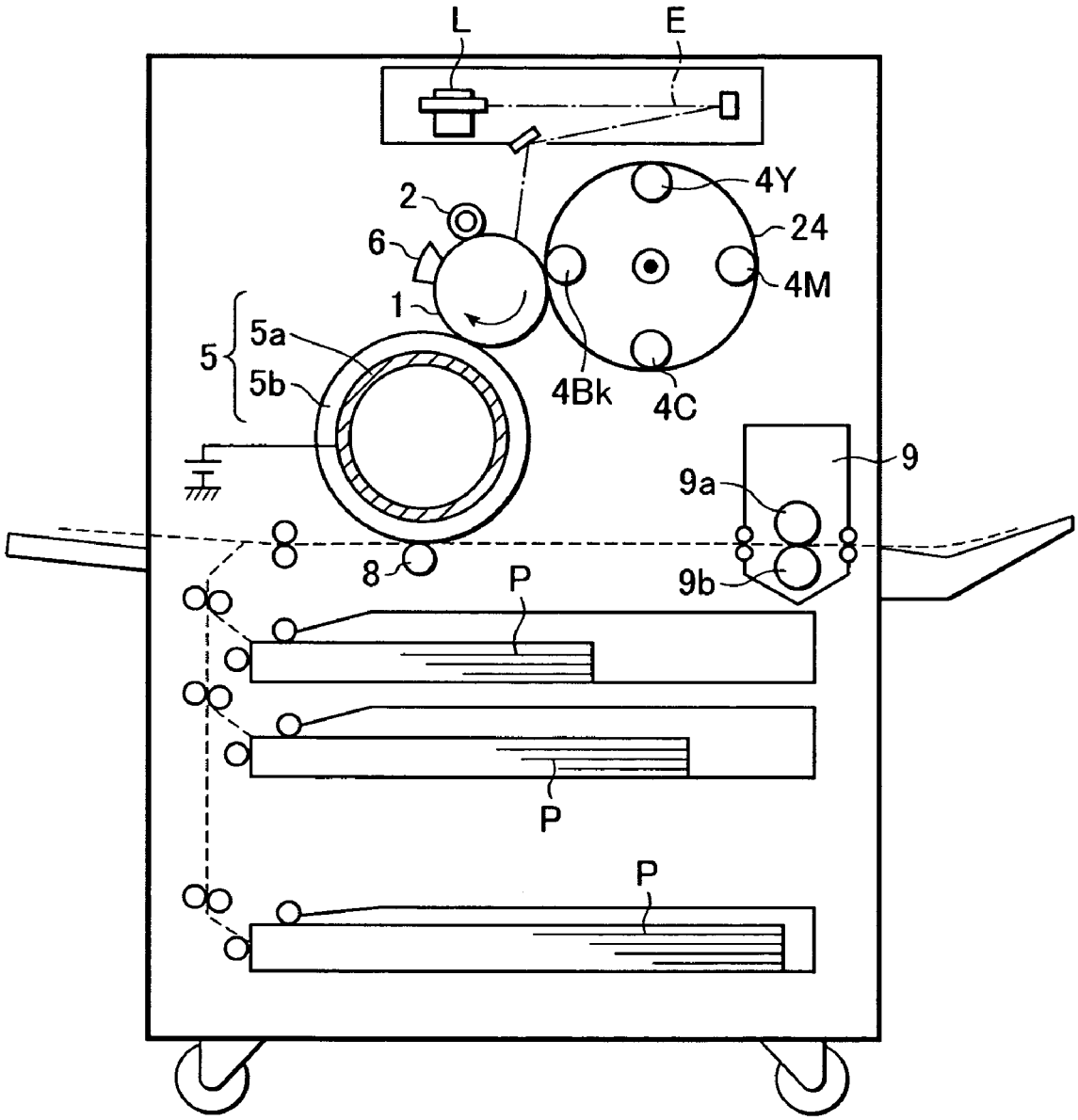
FIG. 2 is a schematic diagram of an image forming apparatus including an intermediate transfer drum for simultaneously transferring multiple toner images onto a recording medium.
Figure 3:
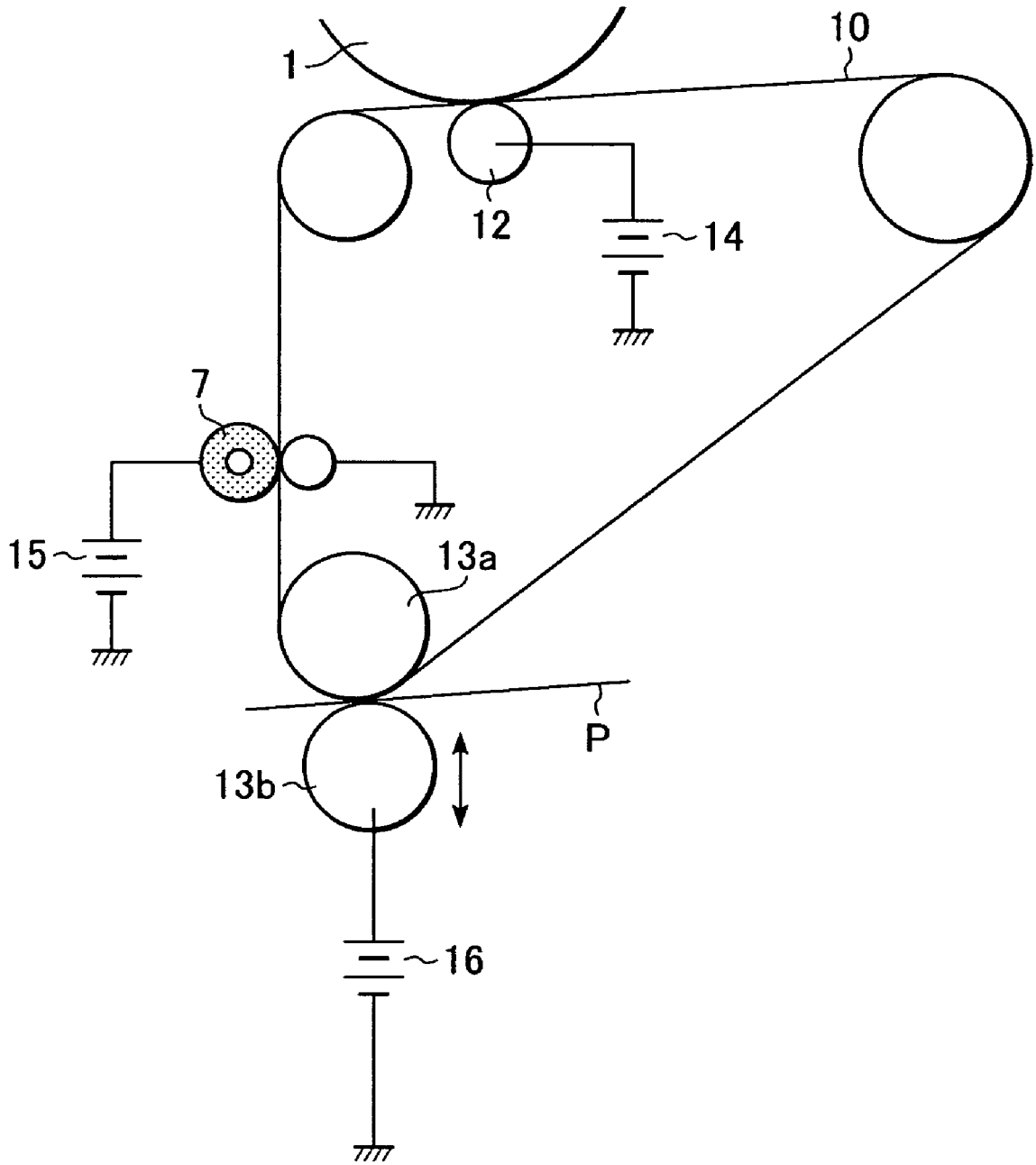
FIG. 3 is a schematic diagram of an intermediate transfer belt.

FIGS. 2 and 3 are schematic diagrams of an example image forming apparatus in which multiple toner images are simultaneously transferred onto a recording medium via an intermediate transfer member.

Referring now to FIG. 2, a rotating charge roller 2, which is a charging member to which a charge bias voltage is applied, is contacted with the surface of a photosensitive drum 1, which is a latent image carrying member, so as to uniformly electrify the surface of the photosensitive drum 1 (primary charging). Meanwhile, laser light E emitted from a light source L forms a first electrostatic latent image on the photosensitive drum 1. The first electrostatic latent image is developed with a black developer (first developer) 4Bk stored in a rotatable rotary unit 24 so as to form a black toner image. The black toner image formed on the photosensitive drum 1 is electrostatically transferred onto an intermediate transfer drum 5 via a transfer bias voltage applied to a conductive support of the intermediate transfer drum 5 (primary transfer). Next, a second electrostatic latent image is formed on the surface of the photosensitive drum 1 in the same manner. The rotatable rotary unit 24 is rotated to develop the second electrostatic latent image using a yellow toner contained in a yellow developer (second developer) 4Y so as to produce an yellow toner image. The yellow toner image is electrostatically transferred onto the intermediate transfer drum 5, which carries the transferred black toner image. A third electrostatic latent image and a fourth electrostatic latent image are prepared in the same manner by rotating the rotatable rotary unit 24 and developed with a magenta toner contained in a magenta developer (third developer) 4M and a cyan toner contained in a cyan developer (fourth developer) 4C, respectively. The developed images are transferred onto the intermediate transfer drum 5 (primary transfer). The multiple toner images on the intermediate transfer drum 5 are electrostatically and simultaneously transferred onto a recording medium P by the application of a transfer bias voltage from a second transfer device 8 (secondary transfer). Here, the second transfer device 8 is placed against the intermediate transfer drum 5 with the recording medium P therebetween. The multiple toner images transferred onto the recording medium P are thermally fixed onto the recording medium P using a fixing device 9 constituted from a heat roller 9*a* and a pressure roller 9*b*. The residual toner remaining on the surface of the photosensitive drum 1 after transfer is recovered and the photosensitive drum 1 is cleaned using a cleaning blade abutting the surface of the photosensitive drum 1.

The primary transfer of toner images from the photosensitive drum 1 to the intermediate transfer drum 5 is carried out through a transfer current generated by applying a bias to the conductive support of the intermediate transfer drum 5, i.e., a first transfer device, from a power supply (not shown).

The intermediate transfer drum 5 is constituted from a rigid conductive support 5*a* and an elastic layer 5*b* covering the conductive support 5*a*. The conductive support 5*a* may be made of metal, such as aluminum, iron, copper, or stainless steel, or an alloy thereof; or a conductive resin in which carbon, metal particles, or the like is dispersed in a resin. Regarding the shape of the conductive support 5*a*, a cylinder, a cylinder with a shaft penetrating the center, a cylinder with reinforced interior, or the like may be employed.

The elastic layer 5*b* may be made of any suitable material. Examples of the preferred material include elastomer rubbers such as styrene-butadiene rubber, high-styrene rubber, butadiene rubber, isoprene rubber, ethylene-propylene copolymer, nitrile-butadiene rubber (NBR), chloroprene rubber, butyl rubber, silicone rubber, fluorine rubber, nitrile rubber, urethane rubber, acryl rubber, epichlorohydrin rubber, and norbornene rubber. Resins such as polyolefin resin, silicone resin, fluorine resin, and polycarbonate, and copolymers and mixtures of these may also be used to form the elastic layer 5*b*.

The surface the elastic layer 5*b* may be coated with a surface layer composed of a dispersion prepared by dispersing a highly water repellent lubricant powder. The lubricant is not particularly limited. Preferable examples of the lubricant include various fluorine resins, fluorine elastomers, and carbon fluoride containing fluorine atoms bonded to graphite; fluorine compounds such as polytetrafluoroethylene (PTFE), polyvinylidene fluoride (PVDF), ethylene-tetrafluoroethylene copolymer (ETFE), and tetrafluoroethylene-perfluoroalkylvinylether (PFA) copolymer; silicone compounds such as silicone resin particles, silicone rubber, silicone elastomer; polyethylene (PE); polypropylene (PP); polystyrene (PS); acrylic resin; polyamide resin; phenol resin; and epoxy resin.

The binder of the surface layer may contain a conductant agent to control the resistance, if necessary. Examples of the conductant agent include various conductive inorganic particles, carbon black, ionic conductant agents, conductive resin, and conductive particles dispersed in resin.

The multiple toner images on the intermediate transfer drum 5 are simultaneously transferred onto the recording medium P using the second transfer device 8 (secondary transfer). The second transfer device 8 may be a noncontact electrostatic transfer unit including a corona charger or a contact electrostatic transfer unit including a transfer roller and a transfer belt.

Instead of using the heat roller 9*a* and the pressure roller 9*b*, the fixing device 9 may include a thermal film fixing device which fixes the multiple toner images on the recording medium P by heating a film in contact with the toner images on the recording medium P so as to heat and fix the toner images on the recording medium P.

Instead of the intermediate transfer member employed in the system shown in FIG. 2, an intermediate transfer belt may be used to simultaneously transfer the multiple toner images on to a recording media. An example of such a structure is illustrated in FIG. 3.

The toner images on the photosensitive drum 1 are sequentially transferred onto the peripheral face of an intermediate transfer belt 10 using an electrical field generated by a first transfer bias applied to the intermediate transfer belt 10 from a first transfer roller 12 during the course of passing through the nip between the photosensitive drum 1 and the intermediate transfer belt 10 (primary transfer).

During the process of primary transfer described above, the transferred toner images of four different colors are superimposed on one another. The primary transfer bias has a polarity opposite to that of the toner and is applied from a bias supply 14.

During the process of primary transfer of toner images of first to third colors, a secondary transfer roller 13*b* and an intermediate transfer belt cleaner 7 may detach from the intermediate transfer belt 10. The secondary transfer roller 13*b* opposes a secondary transfer counter roller 13*a*, and the shafts of the two rollers are parallel to each other.

The superimposed color toner images on the intermediate transfer belt 10 are transferred onto the recording medium P in the following manner. The recording medium P is delivered between the nip between the intermediate transfer belt 10 and the secondary transfer roller 13*b* abutting the intermediate transfer belt 10 at a predetermined timing. A second transfer bias is applied to the secondary transfer roller 13*b* from a bias supply 16, and the second transfer bias transfers the superimposed color toner images on the intermediate transfer belt 10 to the recording medium P (secondary transfer).

Upon completion of image transfer onto the recording medium P, a charging member for cleaning (not shown) is put into contact with the intermediate transfer belt 10 so as to apply a bias having a polarity opposite to that of the photosensitive drum 1 from a bias supply 15. As a result, the residual toner remaining on the intermediate transfer belt 10 after transfer is electrified into a polarity opposite to that of the photosensitive drum 1. The residual toner is electrostatically transferred to the photosensitive drum 1 at the nip or the vicinity of the nip so that the intermediate transfer belt 10 is cleaned.

The intermediate transfer belt 10 is constituted from a belt-shaped base layer and a surface layer covering the base layer. The surface layer may have a multilayer structure.

The base layer and the surface layer may be composed of rubber, elastomer, or resin. For example, the base layer and the surface layer are composed of at least one material selected from the group consisting of the following rubbers and elastomers: natural rubber, isoprene rubber, styrene-butadiene rubber, butadiene rubber, butyl rubber, ethylene-propylene rubber, ethylene-propylene terpolymer, chloroprene rubber, chlorosulfonated polyethylene, polyethylene chloride, acrylonitrile butadiene rubber, urethane rubber, syndiotactic 1,2-polybutadiene, epichlorohydrin rubber, acrylic rubber, silicone rubber, fluorine rubber, polysulfide rubber, polynorbornene rubber, hydrogenated nitrile rubber, and thermoplastic elastomer (e.g., polystyrene resins, polyolefin resins, polyvinylchloride resins, polyurethane resins, polyamide resins, polyester resins, and fluorine resins). Polyolefin resin, silicone resin, fluorine resin, and polycarbonate resin may be used as the-resin. Copolymers or mixtures of these resins may also be used.

The base layer may be formed by making a film from the above-described rubber, elastomer, or resin. In particular, the base layer may be prepared by impregnating a core having a shape of a woven fabric, a nonwoven fabric, a filament, or a film with the above-described rubber, elastomer, or resin or by spraying the above-described rubber, elastomer, or resin onto such a core.

The core may be composed of at least one material selected from the following groups: natural fibers such as cotton, silk, hemp, and wool; recycled fibers such as chitin fiber, alginate fiber, and regenerated cellulose fiber; semi-synthetic fibers such as acetate fibers; synthetic fibers such as polyester fiber, nylon fiber, acryl fiber, polyolefin fiber, polyvinyl alcohol fiber, polyvinyl chloride fiber, polyvinylidene chloride fiber, polyurethane fiber, polyalkylparaoxy benzoate fiber, polyacetal fiber, aramid fiber, polyfluoroethyelene fiber, and phenol fiber; inorganic fiber such as glass fiber, carbon fiber, and boron fiber; and metal fiber such as iron fiber and copper fiber. These examples do not limit the scope of the invention.

In order to adjust the resistance of the intermediate transfer member, a conductant agent may be added into the base layer or the surface layer. The conductant agent may be any suitable agent and may contain at least one material from the following materials: carbon; metal powders such as aluminum and nickel powders; metal oxides such as titanium oxide; and conductive polymer compounds such as polymethyl methacrylate containing quaternary ammonium salt, polyvinylaniline, polyvinylpyrrole, polydiacetylene, polyethyleneimine, polymer compounds containing boron, and polypyrrole. The conductant agent is not limited to the above-described materials.

In order to improve lubricity and transferring capacity of the surface of the intermediate transfer member, a lubricant may be added as required. Preferable examples of the material of the lubricant include fluorine compounds such as various fluorine rubbers, fluorine elastomers, carbon fluoride containing fluorine bonded to graphite, polytetrafluoroethyelene (PTFE), polyvinylidene fluoride (PVDF), ethylene-tetrafluoroethylene copolymer (ETFE), and tetrafluoroethylene-perfluoroalkylvinylether copolymer (PFA); silicone compounds such as silicone resin, silicone rubber, and silicone elastomer; polyethylene (PE); polypropylene (PP); polystyrene (PS); acrylic resin; polyamide resin; phenolic resin; and epoxy resin.

Figure 4:
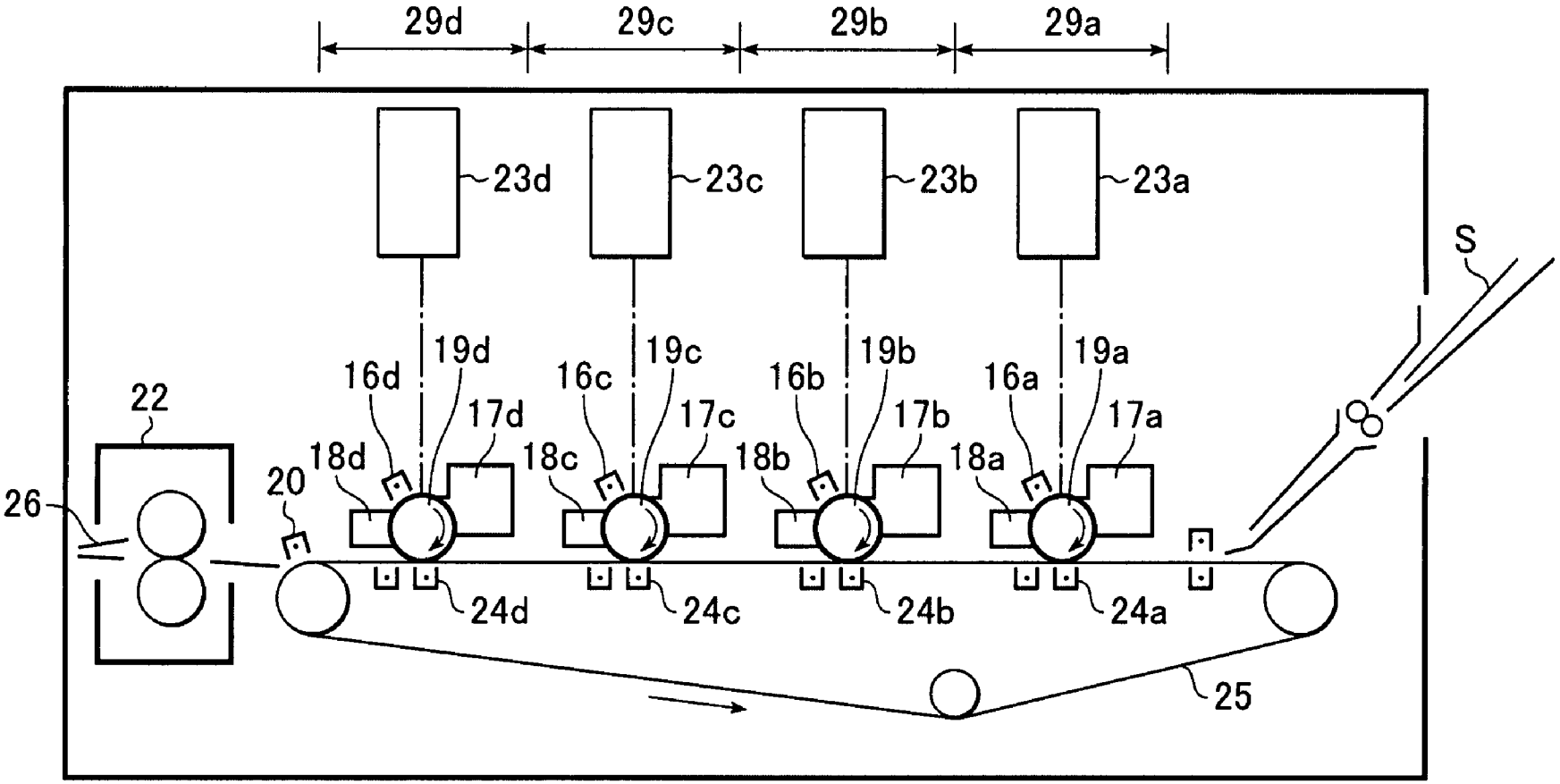
FIG. 4 is a schematic diagram of an image forming apparatus including a plurality of image forming units for respectively forming toner images of different colors, in which the toner images are superimposed on one another by sequentially transforming the toner images onto a recording medium.

A method for forming an image, the method including separately forming toner images of different colors in a plurality of image forming units and sequentially transferring the toner images onto the same recording medium so as to superimpose the toner images, will now be described with reference to FIG. 4.

This method uses a first image forming unit 29*a*, a second image forming unit 29*b*, a third image forming unit 29*c*, and a fourth image forming unit 29*d* having electrostatic latent image carrying members, namely, a photosensitive drum 19*a*, a photosensitive drum 19*b*, photosensitive drum 19*c*, and a photosensitive drum 19*d*, respectively.

The photosensitive drums 19*a*, 19*b*, 19*c*, and 19*d* respectively have charging units 16*a*, 16*b*, 16*c*, and 16*d*; latent image forming units 23*a*, 23*b*, 23*c*, and 23*d*; development units 17*a*, 17*b*, 17*c*, and 17*d*; transfer discharging units 24*a*, 24*b*, 24*c*, and 24*d*; and cleaning units 18*a*, 18*b*, 18*c*, and 18*d*.

For example, in this structure, a yellow-component latent image from the original image is first formed on the photosensitive drum 19*a* of the first image forming unit 29*a* using the latent image forming unit 23*a*. The latent image is developed with a yellow toner in the development unit 17*a* to form a visible image, and the visible image is transferred onto a recording medium S using the transfer discharging unit 24*a*.

While the yellow image is transferred onto the recording medium S, a latent image of a magenta component is formed on the photosensitive drum 19*b* the second image forming unit 29*b*. The latent image is developed with a magenta toner in the development unit 17*b* to form a visible image (magenta toner image), and the magenta toner image is transferred onto a predetermined position of the recording medium S once the recording medium S that received the yellow toner image enters the transfer discharging unit 24*b*.

A cyan image and a black image are formed in the third and fourth image forming units 29*c* and 29*d*, respectively, in the same manner described above. The cyan and black images are transferred onto the same recording medium S. Upon completion of the image forming process, the recording medium S is fed to a fixing unit 22, where the images on the recording medium S is fixed to form a full-color image on the recording medium S. The photosensitive drums 19*a*, 19*b*, 19*c*, and 19*d* are cleaned with the cleaning units 18*a*, 18*b*, 18*c*, and 18*d* by removing the residual toners so as to prepare for the forthcoming image forming.

In the above-described image forming method, a conveyor belt (a belt 25) is used to convey the recording media. The conveyor belt may be constituted from a Tetron (registered trademark) fiber mesh or a thin dielectric sheet composed of polyethylene terephthalate resin, polyimide resin, urethane resin, or the like.

As the recording medium S passes through the fourth image forming unit 29*d*, an AC voltage is applied to a discharger 20 to discharge the recording medium S. The recording medium S detaches from the belt 25, enters the fixing unit 22 where the image is fixed on the recording medium S, and ejected via an ejector 26.

Alternatively, the image forming method may use an electrostatic latent image carrying member common to all of the image forming units, and the recording medium may be repetitively delivered to the transfer section of the electrostatic latent image carrying member via a conveying drum so as to receive the toner images of different colors.

The conveyor belt used in this system has a high volume resistivity. Accordingly, when the transfer process is repeated several times to form a full-color image, the conveyor belt increases the amount of charge. Thus, The transfer current must be increased each time the transfer process is performed in order to uniformly transfer the images. Since the toner of the present invention has excellent transferability, the uniformity in transferability of the individual particles can be maintained by using the same transfer current even though the charge of the conveyor unit increases as the transfer operation is repeated. Therefore, high-quality images can be formed.

Figure 5:
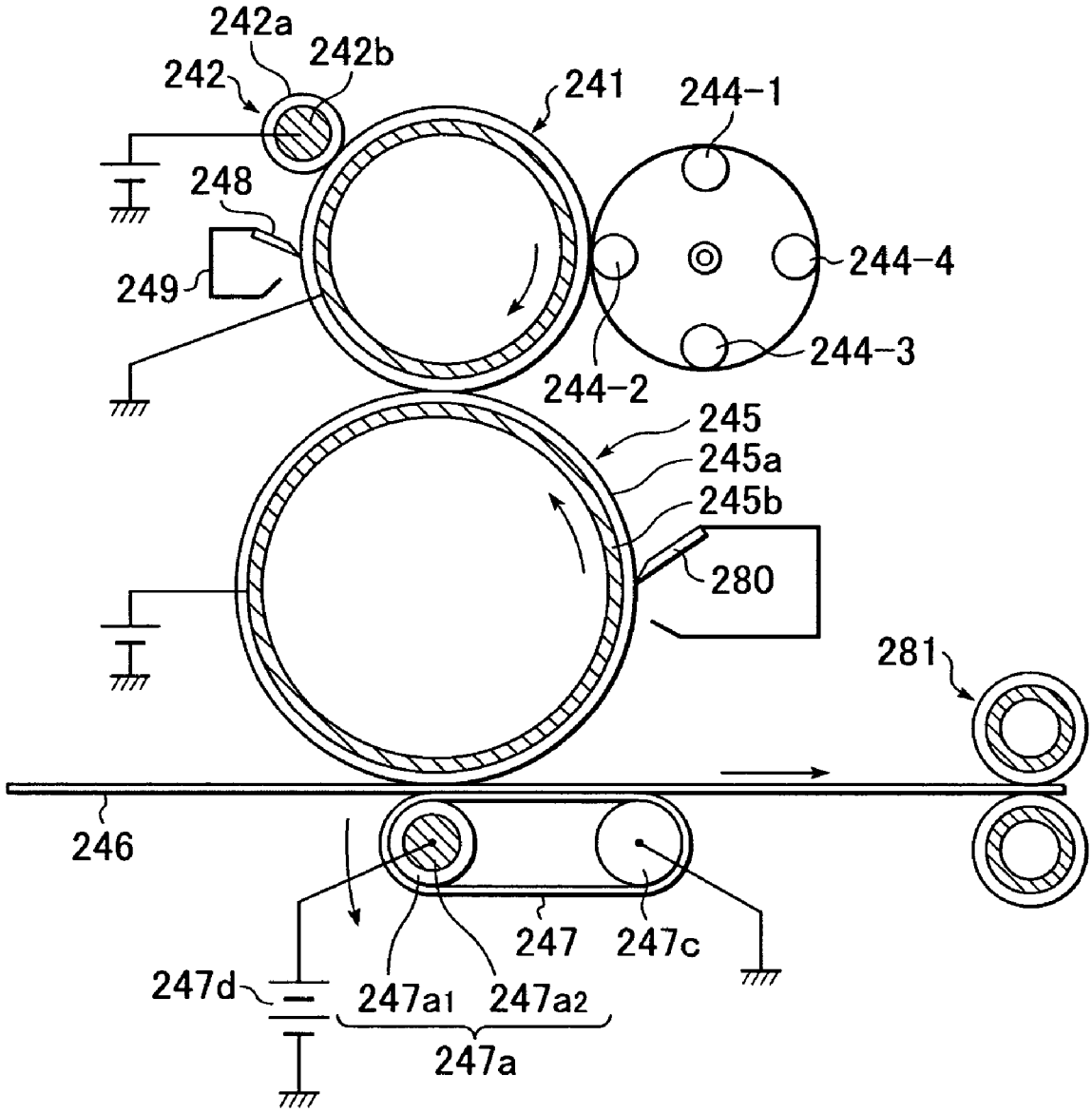
FIG. 5 is a schematic diagram of an image forming apparatus including a transfer belt, which functions as a secondary transfer means for simultaneously transferring four color toner images from an intermediate transfer drum to a recording medium.

FIG. 5 is a diagram for explaining an image forming system using a transfer belt as the means for simultaneously transferring four color toner images on the intermediate transfer drum onto a recording media.

In the system shown in FIG. 5, a developer containing a cyan toner, a developer containing a magenta toner, a developer containing a yellow toner, and a developer containing black toner, respectively, are accommodated in a development unit 244-1, a development unit 244-2 a development unit 244-3, and a development unit 244-4. An electrostatic latent image formed on the charge roller 242 is developed with these developers to form colored toner images on a photosensitive member 241. The photosensitive member 241 is either a photosensitive drum or a photosensitive belt having a photoconductive insulating layer composed of amorphous selenium, CdS, $ZnO_2$, organic photoconductive compounds, amorphous silicon, or the like.

The photosensitive member 241 preferably has an amorphous silicon layer or an organic photosensitive layer. The organic photosensitive layer may be a single layer containing both a charge generating substance and a charge transporting substance or may have a multilayer structure including a charge transport layer and charge-generating layer. In particular, a multilayer photosensitive layer constituted from a conductive base sublayer, a charge generating sublayer, and a charge transport layer, stacked in that order, is preferred.

The binder resin contained in the organic photosensitive layer is preferably polycarbonate resin, polyester resin, or acrylic resin. These materials improve transfer capacity, cleaning property, and reduce cleaning failure, melt-bonding of the toner to the photosensitive member, and filming of external additives.

Figure 6:
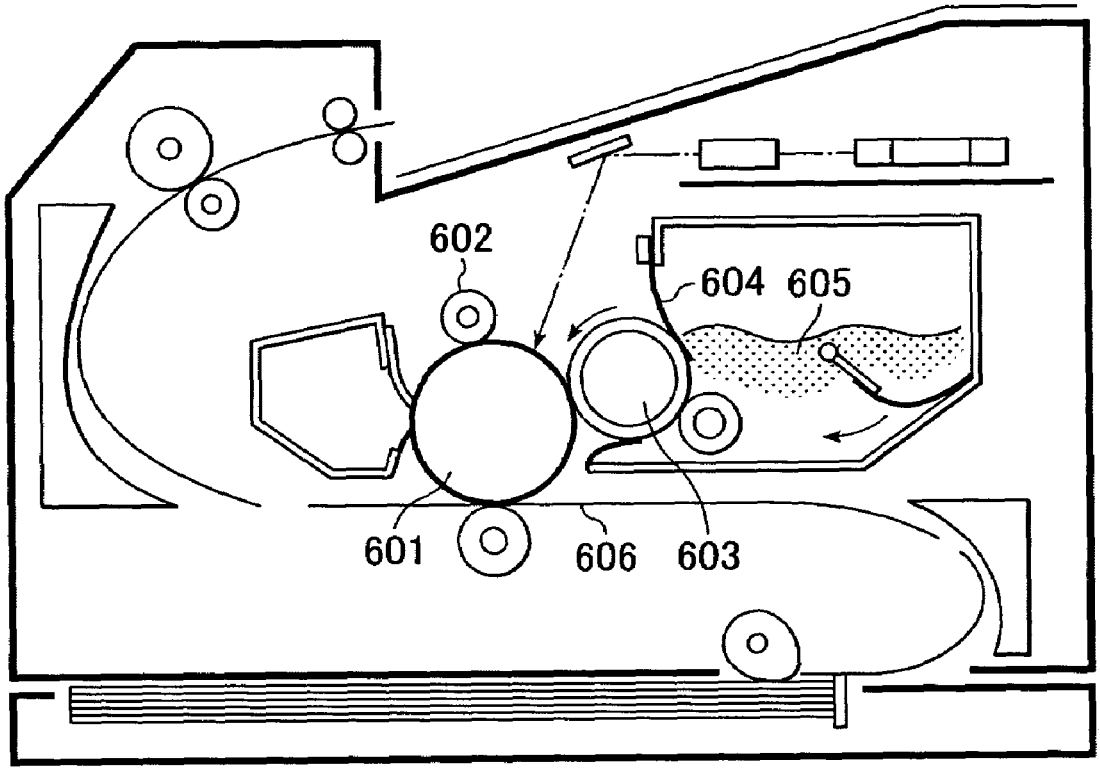
FIG. 6 is a schematic diagram of an image forming apparatus of a contact development type that uses a single-component nonmagnetic toner employed in the Examples herein.

In the charging step, the photosensitive member 241 may be charged by a noncontact method using a corona charger or by a contact method, for example, using a roller. A contact method, such as that shown in FIG. 6, is preferred since the method achieves efficient uniform electrification, employs a simple process, and generates less ozone.

A charge roller 242 is basically constituted from a core 242*b* and a conductive elastic layer 242*a* surrounding the periphery of the core 242*b*. The charge roller 242 is pressed against one side of the photosensitive member 241 at a predetermined pressure and driven by the rotation of the photosensitive member 241.

The roller pressure is preferably 4.9 to 490 N/m (5 to 500 gf/cm). When a DC voltage superimposed with AC voltage is used, the AC voltage is preferably 0.5 to 5 kVpp, the AC frequency is preferably 50 Hz to 5 kHz, and the DC voltage is preferably ±0.2 to ±1.5 kV. When a DC voltage is used, the DC voltage is preferably ±0.2 to ±5 kV.

Examples of other electrification means include a method that uses a charge blade and a method that uses a conductive brush. Such a contact charging means does not require high voltage and can reduce generation of ozone. The charge roller and the charge blade are preferably composed of conductive rubber and may have a releasing film at the surface. The releasing film may be composed of nylon resin, polyvinylidene fluoride (PVDF), polyvinylidene chloride (PVDC), or the like.

The toner image on the photosensitive member is transferred onto an intermediate transfer drum 245 to which a voltage of, for example, ±0.1 to ±5 kV is applied. The surface of the photosensitive member after transfer is cleaned with a cleaning unit 249 having a cleaning blade 248.

The intermediate transfer drum 245 is constituted from a tubular conductive core 245*b* and an elastic layer 245*a* having intermediate resistance covering the periphery of the core 245*b*. The core 245*b* may be a plastic tube plated with a conductive material.

The elastic layer 245*a* is a solid or a foam having an electrical resistance (volume resistivity) adjusted in the range of $10^5$ to $10^{11}$ Ω·cm by dispersing a conductant, such as carbon black, zinc oxide, tine oxide, or silicon carbide, into an elastic material, such as silicone rubber, Teflon (registered trademark), chloroprene rubber, urethane rubber, ethylenepropylenediene rubber (EPDM).

The shaft of the intermediate transfer drum 245 is parallel to the photosensitive member 241, and the surface of the intermediate transfer drum 245 is put into contact with the lower face of the photosensitive member 241. The intermediate transfer drum 245 rotates counterclockwise in the direction of arrow at the same speed with the photosensitive member 241.

As a first color toner image on the photosensitive member 241 passes through the transfer nip between the photosensitive member 241 and the intermediate transfer drum 245, the electric field produced around the nip by the transfer bias applied to the intermediate transfer drum 245 sequentially transfers the first color toner image onto the outer surface of the intermediate transfer drum 245 (intermediate transfer).

The surface of the intermediate transfer drum 245 is cleaned with a cleaning unit 280 after the toner image transfer. During the time which the intermediate transfer drum 245 carries toner images, the cleaning unit 280 is detached from the surface of the intermediate transfer drum 245 so as not to disarrange the toner images.

A transfer unit 247 is put into contact with the lower face of the intermediate transfer drum 245, the shaft of which is parallel to the shaft of the transfer unit 247. The transfer unit 247 is, for example, a transfer roller or a belt and rotates in the direction of the arrow at the same peripheral velocity as the intermediate transfer drum 245. The transfer unit 247 may make direct contact with the transfer unit 247 or indirect contact with the transfer unit 247 with a belt or the like therebetween.

When a transfer roller is used as the transfer unit 247, the transfer roller is basically constituted from a core and a conductive elastic layer surrounding the core.

The transfer drum and the transfer roller, which is used as the transfer unit 247, may be composed of a material commonly used to make transfer drums and rollers. The volume resistivity of the elastic layer of the transfer roller is adjusted to be lower than that of the elastic layer of the intermediate transfer drum 245 to reduce the voltage applied to the transfer roller. In this manner, satisfactory toner images can be formed on the recording medium while preventing the recording medium from attaching to the intermediate transfer member. In particular, the volume resistivity of the elastic layer of the intermediate transfer member is preferably 10 times larger than the volume resistivity of the elastic layer of the transfer roller.

The hardness of the intermediate transfer drum 245 and the transfer roller used as the transfer unit 247 is measured according to Japanese Industrial Standards (JIS) K-6301. The intermediate transfer drum 245 used in the present invention preferably includes an elastic layer having a hardness of 10 to 40 degrees. The transfer roller preferably includes an elastic layer having a hardness of 41 to 80 in order to prevent attachment of the transfer medium onto the intermediate transfer drum 245. When the hardness of the intermediate transfer drum 245 and the hardness of the transfer roller are reversed, dents will be formed in the transfer roller, and the transfer medium easily attaches onto the intermediate transfer drum.

In the system shown in FIG. 5, a transfer belt is disposed below the intermediate transfer drum 245 and functions as the transfer unit 247. The transfer belt is stretched across two rollers, namely a bias roller 247*a* and a tension roller 247*c*, parallel to the shaft of the intermediate transfer drum 245. The transfer belt is driven using a driver (not shown). The transfer roller can detach from the intermediate transfer drum 245 by the movement in the arrow direction since the bias roller 247*a* rotates about the tension roller 247*c* in the arrow direction. A secondary transfer bias is applied to the bias roller 247*a* from a secondary transfer bias source 247*d*. The tension roller 247*c* is grounded.

The transfer belt of this embodiment is a rubber belt constituted from a thermosetting urethane elastomer layer (thickness: about 300 μm; volume resistivity (1 kV): $10^8$ to $10^{12}$ Ω·cm) containing dispersed carbon and a fluorine rubber layer (thickness: 20 μm; volume resistivity (1 kV): $10^{15}$ Ω·cm) disposed on the thermosetting urethane elastomer layer. The transfer belt is tubular and has an outer peripheral length of 80 mm and an outer width of 300 mm.

Tensile force is applied to the transfer belt 247 through the bias roller 247*a* and the tension roller 247*c* to stretch the transfer belt by about 5%.

The transfer unit 247 rotates at the same speed with or a higher speed than the intermediate transfer drum 245. A bias is applied to the transfer unit 247 from the secondary transfer bias source 247*d* while a recording medium 246 is being sent through the gap between the intermediate transfer drum 245 and the transfer unit 247. Here, the applied bias has a polarity opposite to that of the frictional charge of the toner so that a toner image on the intermediate transfer drum 245 is transferred onto the surface of the recording medium 246.

The transfer roller may be composed of the same material as that of the charge roller. The transferring process is preferably conducted at a roller pressure of 4.9 to 490 N/m (5 to 500 gf/cm) at a DC current of ±0.2 to ±10 kV.

For example, the transfer unit 247 includes a conductive elastic layer 247*a*1 composed of an elastic material having a volume resistivity of $10^6$ to $10^{10}$ Ωcm. Examples of such a material include urethane and ethylene-propylene-diene copolymers (EPDM). The transfer unit 247 also includes a core 247*a*2 to which a bias is applied from a constant voltage power supply. The bias condition is preferably ±0.2 to ±10 kV.

Subsequently, the recording medium 246 is delivered to a fixing unit 281 basically constituted from a heat roller incorporating a heater such as a halogen heater, and an elastic pressure roller pressed against the heat roller. As the recording medium 246 passes through the gap between the heat roller and the pressure roller, the toner image is fixed onto the recording medium by heating under pressure. Alternatively, toner images may be fixed via a film using a heater.

EXAMPLES

The present invention will now be described by way of SYNTHETIC EXAMPLES and EXAMPLES. These examples do not limit the scope of the present invention. In the examples, the unit "part(s)" means "part(s) by weight".

Synthetic Example of Preparing Polar Polymer 1

A polar polymer, which is the sulfur-containing resin used in the present invention, was prepared as follows.

In a pressure-resistant reaction vessel equipped with a reflux duct, a stirrer, a thermometer, a nitrogen duct, a dropping apparatus, and a decompressor, solvents, i.e., 250 parts of methanol, 150 parts of 2-butanone, and 100 parts of 2-propanol, and monomers, i.e., 82 parts of styrene, 10 parts of 2-ethylhexyl acrylate, and 8 parts of 2-acrylamide-2-methylpropane sulfonate, were mixed, and the resulting mixture was heated to a reflux temperature with stirring. To the mixture, a solution of 1 part of t-butylperoxy-2-ethylhexanoate (polymerization initiator) in 20 parts of 2-butanone was added dropwise over 30 minutes and the mixture was stirred for five hours. To the mixture, a solution of 1 part of t-butylperoxy-2-ethylhexanoate (polymerization initiator) in 20 parts of 2-butanone was again added dropwise over 30 minutes, and the mixture was stirred for another five hours to complete the polymerization. While maintaining the temperature, 1,000 parts of deionized water was added to the mixture, and the resulting mixture was stirred for two hours at 80 to 100 rpm so as not to disrupt the interface between the organic layer and the aqueous layer, and was left to stand for 30 minutes to separate the layers. Subsequently, the aqueous layer was discarded, and anhydrous sodium sulfate was added to the organic layer to dehydrate the organic layer.

A polymer obtained by extracting the polymerization solvent under reduced pressure was roughly pulverized into particles of 100 μm or less with a cutter mill equipped with a 150-mesh screen. The resulting polar polymer had Tg of about 75° C. The obtained polar polymer is hereinafter referred to as "polar polymer 1".

Synthetic Example of Preparing Polar Polymers 2 to 8

Polar polymers 2 to 8 were prepared as in SYNTHETIC EXAMPLE for preparing the polar polymer 1 described above except that the type and/or amount of the monomer used and the amount of water added after the polymerization were changed as in Table 1 below.

TABLE 1

| | Amount of 2-acrylamide-2-methylpropane sulfonate monomer (part) | Amount of styrene monomer (part) | Monomer 1 (part) | Monomer 2 (part) | Tg (° C.) | Amount of water added after polymerization (part) |
|---|---|---|---|---|---|---|
| Polar polymer 1 | 8 | 82 | 2-ethylhexyl acrylate (10) | — | 75 | 1000 |
| Polar polymer 2 | 6 | 82 | n-butylacrylate (12) | — | 70 | 100 |
| Polar polymer 3 | 4 | 82 | 2-ethylhexyl acrylate (14) | — | 67 | 500 |
| Polar polymer 4 | 1 | 82 | 2-ethylhexyl acrylate (14) | sulfoethyl methacrylate (3) | 69 | 500 |
| Polar polymer 5 | 4 | 81 | 2-ethylhexyl acrylate (14) | acryloyl morpholine (1) | 67 | 500 |
| Polar polymer 6 | 4 | 80 | 2-ethylhexyl acrylate (14) | acryloyl morpholine (2) | 68 | 500 |
| Polar polymer 7 | 8 | 82 | 2-ethylhexyl acrylate (10) | — | 74 | 0 |
| Polar polymer 8 (Comparative Example) | — | 88 | 2-ethylhexyl acrylate (12) | — | 72 | 500 |

Example 1

To 900 parts of ion-exchange water heated to 60° C., 3 parts of tricalcium phosphate was added, and the mixture was stirred at 10,000 rpm using a TK Homomixer (manufactured by Tokushu Kika Kogyo Co., Ltd.) to prepare an aqueous medium.

A polymerizable monomer composition, the components of which are described below, was placed in a TK Homomixer (manufactured by Tokushu Kika Kogyo Co., Ltd.), heated to 60° C., and stirred at 9,000 rpm to prepare a homogenous mixture:

162 parts of styrene;

38 parts of n-butylacrylate;

10 parts of C.I. Pigment Blue 15:3;

1 part of polar polymer 1;

20 parts of polyester resin;

24 parts of a polycondensate of propylene-oxide-modified bisphenol A and isophthalic acid (Tg=67° C., Mw=10,000, Mn=6,300); and 1.0 part of divinylbenzene.

To the homogeneous mixture, 7 parts of a polymerization initiator, namely, 2,2'-azobis(2,4-dimethylvaleronitrile) was dissolved to prepare a polymerizable monomer composition.

The polymerizable monomer composition was mixed with the above-described aqueous medium, and the mixture was stirred at 60° C. in nitrogen atmosphere using a TK Homomixer at 11,000 rpm to form particles.

The resulting particles were charged into a propeller stirrer and heated to 70° C. with stirring over two hours. After four hours, the temperature was increased to 80° C. at a heating rate of 40° C./hr, and the reaction was conducted at 80° C. for five hours to prepare polymer particles. Upon completion of the polymerization reaction, the slurry containing the polymer particles was cooled, blended with hydrochloric acid to adjust pH to 1.4, and washed with water in amount ten times larger than the amount of the slurry. The washed slurry was filtered, dried, and classified to prepare cyan toner particles having a predetermined diameter.

The cyan toner particles were filtered, washed with ion-exchange water, and dried to prepare toner particles (sample toner particles 1). The toner particles contained a total of 680 ppm of phosphorus and calcium.

To 100 parts of the toner particles, 1.5 parts of hydrophilic silica fine powder (BET: 180 $m^2/g$), treated with hexamethyldisilazane and subsequently with silicone oil, was added to improve the flowability and the resulting mixture was dry-mixed with a Henschel mixer (manufactured by Mitsui Mining Company, Limited) for five minutes to prepare a toner (sample toner 1) of the present invention.

The toner 1 had a weight-average particle diameter of 6.8 μm, and an average circularity of 0.984. The physical properties of the toner particles and the toner are shown in Table 2.

Using sample toner 1 and an image forming apparatus shown in FIG. 6, test on image quality was carried out in a high-temperature and high-humidity environment (30° C., 80% RH) and in a low-temperature and low-humidity environment (15° C., 10% RH).

FIG. 6 is a schematic view of the image forming apparatus. The image forming apparatus includes a photosensitive member 601, a charge roller 602, a toner-carrying member 603, a blade 604, a developer (toner) 605, and a recording medium 606. The apparatus was a converted model of a 1,200 dpi laser beam printer (LBP-840, manufactured by Canon Inc.), which is an electrophotographic system of a contact development type using a nonmagnetic monocomponent toner. For the purpose of this testing, the following changes were effected on the original printer:

(a) The charging method was changed to direct charging method using a contact rubber roller, and only the DC component (−1,200 V) was used as the applied voltage;

(b) The toner-carrying member was changed to an intermediate-resistance rubber roller composed of carbon-black-dispersed silicone rubber (diameter: 16 mm, Asker-C hardness: 45 degrees, resistance: $10^5$ Ω·cm), and the toner-carrying member was arranged to abut the developer (toner) 601;

(c) The rotation speed of the toner-carrying member 603 was 140% of the rotation speed of the photosensitive member 601, and the rotation direction of the toner-carrying member 603 at the nip between the photosensitive member 601 and the toner-carrying member 603 is the same as the rotation direction of the photosensitive member 601 at the nip;

(d) The original photosensitive member was replaced with a photosensitive member prepared by sequentially forming the following layers on an aluminum cylinder by dipping:

a conductive coating layer 15 μm in thickness mainly composed of phenol resin containing dispersed particles of tin oxide and titanium oxide;

an underlayer 0.6 μm in thickness mainly composed of modified nylon and copolymerized nylon;

a charge generating layer, 0.6 μm in thickness, mainly composed of butyral resin containing dispersed titanylphthalocyanine pigment having an absorption in the long wavelength region; and a charge transport layer, 20 μm in thickness, mainly composed of a material prepared by dissolving a hole-transporting triphenylamine compound in polycarbonate resin (molecular weight of 20,000 by Ostwald viscosity method), the weight ratio of the compound to the resin being 8:10;

(e) An application roller composed of urethane rubber foam was installed inside the developing unit and was pressed against the toner-carrying member 603 so as to apply the toner onto the toner-carrying member 603, and a voltage of about −550 V was applied to the application roller;

(f) A resin-coated stainless steel blade was used to regulate the coating toner layer on the toner-carrying member 603. The NE length of the blade was measured as follows: a thin layer of a commercially available paint was applied on the surface of a rubber roller having the same diameter, hardness, and resistance as those of the toner-carrying member 603 to form a thin layer; after the image forming apparatus was temporality assembled, the rubber roller was dismounted, and the surface of the stainless blade was observed with an optical microscope to determine the NE length. The NE length was 1.05 mm.;

(g) Only the DC component (−450 V) was applied during the development process; and (h) the contact pressure of the cleaning blade was reduced to 85% of the default value.

Moreover, the following changes were made to comply with the above-described changes.

The potential of the dark space of the photosensitive member was changed to −600V, and that of the white space was changed to −150 V. The transfer bias applied to the transfer roller was changed to +700 V.

Under the following conditions, 5,000 copies, each carrying an image having a printing percentage of 2%, were printed in a high-temperature-high-humidity environment and a low-temperature-low-humidity environment, respectively. In printing 5,000 copies in the low-temperature low-humidity environment, a halftone image was output for every 100 copies to examine the occurrence of cleaning failure on the halftone image. Upon completion of output in high-temperature-high-humidity environment, the state of scattered toner in the apparatus was examined and evaluated.

The image quality was assessed by the following conditions. The image density and the image fogging were also examined.

(1) Cleaning Failure

A: Excellent (no cleaning failure occurred)

B: Good (slight cleaning failure occurred two times or less)

C: Sufficient from a practical standpoint (slight cleaning failure occurred three to five times)

D: Poor (slight cleaning failure occurred six times or more, or apparent cleaning failure occurred)

(2) Toner Scattering

A: Excellent (no cleaning failure occurred)

B: Good (slight cleaning failure occurred two times or less)

C: Sufficient from a practical standpoint (slight cleaning failure occurred three to five times)

D: Poor (toner scattered around the development cartridge)

(3) Image Density

The image density was assessed from solid images formed on normal printing paper (75 g/m$^2$) output at an early stage of the printing test and at the end of the durability test according to the standard described below. The image density was determined by measuring the density of the white area (original density: 0.00) relative to the printed image using a Macbeth densitometer RD918 (manufactured by McBeth).

A: Excellent (1.40 or more)

B: Good (at least 1.35 and less than 1.40)

C: Sufficient from a practical standpoint (at least 1.00 and less than 1.35)

D: Poor (less than 1.00)

(4) Image Fogging

The difference between the whiteness of the white background of the printed image and the whiteness of the recording medium was determined with a reflectometer (TC-6DS, Tokyo Denshoku Co., Ltd.) to calculate the fogging density (%). Images output at the end of the durability test were evaluated. An amberlite filter was used for cyan, a blue filter was used for yellow, and a green filter was used for magenta and black.

A: Excellent (less than 0.5%)

B: Good (at least 0.5% but less than 1.0%)

C: Sufficient from a practical standpoint (at least 1.0% but less than 1.5%)

D: Poor (1.5% or less)

Example 2

A toner was prepared as in EXAMPLE 1 except that the polar polymer was changed from the polar polymer 1 to the polar polymer 2.

Example 3

A toner was prepared as in EXAMPLE 1 except that the polar polymer was changed from the polar polymer 1 to the polar polymer 3 and the amount of the polar polymer was changed to 1.5 parts.

Example 4

A toner was prepared as in EXAMPLE 1 except that the polar polymer was changed from the polar polymer 1 to the polar polymer 4 and the amount of the polar polymer was changed to 1.2 parts.

Examples 5 and 6

Toners of EXAMPLES 5 and 6 were prepared as in EXAMPLE 1 but with the polar polymer 5 and the polar polymer 6, respectively.

Example 7

A toner was prepared as in EXAMPLE 1 except that the time of mixing using the Henschel mixer was reduced to 1 minute 30 seconds.

Examples 8 to 10

Toners of EXAMPLES 8 to 10 were prepared as in EXAMPLE 1, except that the amount of hydrochloric acid added upon completion of the polymerization was changed to adjust the pH values to 1.8, 2.1, and 2.4, respectively.

Example 11

A toner was prepared as in EXAMPLE 1 except that 1.5 parts of hydrophobic silica fine powder (BET: 160 $m^2/g$) treated only with silicone oil was added to improve the flowability.

Example 12

A toner was prepared as in EXAMPLE 1, except that 1.2 parts of hydrophobic silica fine powder (BET: 180 $m^2/g$) treated with hexamethyldisilazane and subsequently with silicone oil and 0.3 part of hydrophobic titanium oxide fine powder treated with hexamethyldisilazane were added to improve the flowability.

Example 13

A toner was prepared as in EXAMPLE 1 but with 0.1 part of the polar polymer 1.

Example 14

A toner was prepared as in EXAMPLE 1 but with 4 parts of the polar polymer 1.

Example 15

A toner was prepared as in EXAMPLE 1 except that the amount of calcium phosphate salt was increased to adjust the average particle diameter.

Example 16

A toner was prepared as in EXAMPLE 1 except that the amount of calcium phosphate salt was decreased to adjust the average particle diameter.

Example 17

A toner was prepared as in EXAMPLE 1 except that, after the formation of particles, stirring was continued for two hours, 10 parts of xylene was added to the mixture, and the resulting mixture was heated to 90° C. at a rate of 30° C./15 min two hours later.

Comparative Example 1

A toner was prepared as in EXAMPLE 1 but with the polar polymer 8 instead of the polar polymer 1.

Comparative Example 2

A toner was prepared as in EXAMPLE 1 but with the polar polymer 7 instead of the polar polymer 1.

Comparative Example 3

A toner was prepared as in EXAMPLE 2 except that the amount of the polar polymer 2 was changed to 1.5 part and the amount of the calcium phosphate salt was increased to adjust the average particle diameter.

Comparative Example 4

A toner was prepared as in EXAMPLE 2 except that the amount of the calcium phosphate salt was decreased to adjust the average particle diameter.

Comparative Example 5

A toner was prepared as in EXAMPLE 2 but with 3 parts of the polar polymer 2.

Comparative Example 6

A toner was prepared as in EXAMPLE 2 except that the toner particles before removal of the calcium phosphate salt were treated with hot water of 98° C. under 1 atm to promote formation of conglomerates.

The physical properties of the toner particles and the toners of EXAMPLES and COMPARATIVE EXAMPLES are shown in Table 2. The test results of the toner particles and the toners of EXAMPLES and COMPARATIVE EXAMPLES are shown in Table 3.

TABLE 2

| | Toner particles | | Toner | | | | | | |
|---|---|---|---|---|---|---|---|---|---|
| | T (ppm) | T/S | Average circularity | Weight-average particle diameter (μm) | F/E | (S − f)/(S − m) | E/A | Mode circularity | Percentage of free silica (%) |
| EXAMPLE 1 | 680 | 7.1 | 0.984 | 6.8 | 3.4 | 1.15 | 0.0032 | 1.00 | 0.36 |
| EXAMPLE 2 | 750 | 10.5 | 0.977 | 6.5 | 4.3 | 1.22 | 0.0023 | 1.00 | 1.34 |
| EXAMPLE 3 | 200 | 5.6 | 0.979 | 7.2 | 4.8 | 1.18 | 0.0026 | 1.00 | 0.55 |
| EXAMPLE 4 | 120 | 16.8 | 0.977 | 6.4 | 0.8 | 1.28 | 0.0030 | 1.00 | 1.80 |
| EXAMPLE 5 | 700 | 14.7 | 0.979 | 6.6 | 6.3 | 1.44 | 0.0030 | 1.00 | 0.76 |
| EXAMPLE 6 | 600 | 6.3 | 0.978 | 6.4 | 8.2 | 1.25 | 0.0030 | 1.00 | 0.03 |
| EXAMPLE 7 | 680 | 7.1 | 0.980 | 6.7 | 3.2 | 1.32 | 0.0030 | 1.00 | 5.20 |
| EXAMPLE 8 | 1100 | 11.6 | 0.983 | 6.7 | 3.4 | 1.18 | 0.0029 | 1.00 | 0.53 |

TABLE 2-continued

| | Toner particles | | Toner | | | | | | |
|---|---|---|---|---|---|---|---|---|---|
| | T (ppm) | T/S | Average circularity | Weight-average particle diameter (μm) | F/E | (S − f)/(S − m) | E/A | Mode circularity | Percentage of free silica (%) |
| EXAMPLE 9 | 1600 | 16.8 | 0.984 | 6.7 | 2.8 | 1.17 | 0.0027 | 1.00 | 0.71 |
| EXAMPLE 10 | 1800 | 18.9 | 0.983 | 6.8 | 3.1 | 1.66 | 0.0025 | 1.00 | 2.10 |
| EXAMPLE 11 | 680 | 7.1 | 0.983 | 6.7 | 2.7 | 1.22 | 0.0030 | 1.00 | 0.56 |
| EXAMPLE 12 | 680 | 7.1 | 0.983 | 6.7 | 2.8 | 1.22 | 0.0030 | 1.00 | 0.51 |
| EXAMPLE 13 | 110 | 23.1 | 0.987 | 7.0 | 5.2 | 1.25 | 0.0002 | 1.00 | 2.14 |
| EXAMPLE 14 | 1900 | 10.0 | 0.962 | 5.9 | 1.2 | 1.23 | 0.0055 | 1.00 | 1.56 |
| EXAMPLE 15 | 880 | 9.2 | 0.988 | 5.2 | 1.8 | 0.98 | 0.0024 | 1.00 | 0.72 |
| EXAMPLE 16 | 490 | 5.1 | 0.971 | 9.1 | 5.0 | 1.33 | 0.0035 | 1.00 | 0.43 |
| EXAMPLE 17 | 710 | 7.5 | 0.965 | 6.9 | 3.3 | 1.28 | 0.0029 | 0.99 | 0.81 |
| COMPARATIVE EXAMPLE 1 | 180 | — | 0.984 | 6.8 | — | — | — | 1.00 | 0.41 |
| COMPARATIVE EXAMPLE 2 | 3000 | 31.5 | 0.979 | 6.7 | 2.9 | 1.22 | 0.0021 | 1.00 | 1.30 |
| COMPARATIVE EXAMPLE 3 | 1300 | 24.3 | 0.981 | 2.9 | 4.3 | 1.02 | 0.0023 | 1.00 | 0.46 |
| COMPARATIVE EXAMPLE 4 | 2800 | 39.2 | 0.978 | 12.0 | 1.8 | 1.31 | 0.0020 | 1.00 | 1.80 |
| COMPARATIVE EXAMPLE 5 | 8000 | 74.7 | 0.948 | 9.2 | 1.9 | 1.40 | 0.0044 | 0.98 | 2.20 |
| COMPARATIVE EXAMPLE 6 | 2800 | 39.2 | 0.997 | 6.6 | 2.9 | 1.36 | 0.0026 | 1.00 | 1.50 |

TABLE 3

| | Low-temperature low-humidity environment | | | | High-temperature high-humidity environment | | | |
|---|---|---|---|---|---|---|---|---|
| | Cleaning failure | Image density (early stage) | Image density (at the end) | Fogging | Toner scattering | Image density (early stage) | Image density (at the end) | Fogging |
| EXAMPLE 1 | A | A | A | A | A | A | A | A |
| EXAMPLE 2 | A | A | A | A | B | A | A | A |
| EXAMPLE 3 | A | A | A | B | A | A | A | A |
| EXAMPLE 4 | B | A | B | A | A | A | A | A |
| EXAMPLE 5 | A | A | A | A | B | A | B | B |
| EXAMPLE 6 | A | A | A | A | C | A | B | C |
| EXAMPLE 7 | B | B | C | C | C | A | B | C |
| EXAMPLE 8 | A | A | B | B | B | B | B | B |
| EXAMPLE 9 | A | A | B | B | C | B | C | C |
| EXAMPLE 10 | A | A | B | C | C | C | C | C |
| EXAMPLE 11 | A | A | A | B | A | A | A | B |
| EXAMPLE 12 | A | A | A | A | A | A | A | B |
| EXAMPLE 13 | C | B | C | B | C | B | C | C |
| EXAMPLE 14 | C | B | B | B | C | A | A | C |
| EXAMPLE 15 | C | B | B | B | C | A | A | C |
| EXAMPLE 16 | A | B | C | B | A | B | C | C |
| EXAMPLE 17 | A | B | C | C | C | B | C | C |
| COMPARATIVE EXAMPLE 1 | D | C | D | D | D | C | B | C |
| COMPARATIVE EXAMPLE 2 | B | B | C | C | D | B | C | D |
| COMPARATIVE EXAMPLE 3 | D | C | D | D | D | B | C | D |
| COMPARATIVE EXAMPLE 4 | B | B | C | C | C | C | C | D |
| COMPARATIVE EXAMPLE 5 | D | D | D | D | D | D | D | D |
| COMPARATIVE EXAMPLE 6 | D | B | C | D | B | C | B | C |

Example 18

A toner was prepared as in EXAMPLE 1 except that magnesium hydroxide salt was used as the dispersion stabilizer to replace calcium phosphate salt. Magnesium hydroxide salt was prepared from aqueous magnesium chloride and aqueous sodium hydroxide. The obtained toner particles contained 800 ppm of magnesium.

Example 19

A toner was prepared as in EXAMPLE 1 except that aluminum hydroxide salt dispersed in water was used as the dispersion stabilizer to replace calcium phosphate salt. The obtained toner particles contained 860 ppm of aluminum.

Example 20

A toner was prepared as in EXAMPLE 1 except that zinc phosphate salt dispersed in water was used as the dispersion stabilizer to replace calcium phosphate salt. The obtained toner particles contained a total of 670 ppm of phosphorus and zinc.

Example 21

A toner was prepared as in EXAMPLE 1 except that barium sulfate salt was used as the dispersion stabilizer to replace calcium phosphate salt. The obtained toner particles contained 560 ppm of barium.

Example 22

A toner was prepared as in EXAMPLE 1 except that 8 parts of C.I. Pigment Red 122 was used as the coloring agent instead of 5 parts of C.I. Pigment Blue 15:3.

Example 23

A toner was prepared as in EXAMPLE 1 except that 5 parts of C.I. Pigment Yellow 93 was used as the coloring agent instead of 5 parts of C.I. Pigment Blue 15:3.

Example 24

A toner was prepared as in EXAMPLE 1 except that 8 parts of carbon black (DBP oil absorption: 42 $cm^3$/100 g, specific surface area: 60 $m^2$/g) was used as the coloring agent instead of 5 parts of C.I. Pigment Blue 15:3.

The physical properties of the toners are shown in Table 4, and the test results are shown in Table 5.

TABLE 4

| | Toner particles | | Toner | | | | | | |
|---|---|---|---|---|---|---|---|---|---|
| | T (ppm) | T/S | Average circularity | Weight-average particle diameter (μm) | F/E | (S − f)/(S − m) | E/A | Mode circularity | Percentage of free silica (%) |
| EXAMPLE 18 | 800 | 8.4 | 0.985 | 6.7 | 3.6 | 1.15 | 0.0032 | 1.00 | 0.36 |
| EXAMPLE 19 | 860 | 9.0 | 0.984 | 6.8 | 3.1 | 1.19 | 0.0031 | 1.00 | 0.44 |
| EXAMPLE 20 | 670 | 7.0 | 0.984 | 8.2 | 4.2 | 1.26 | 0.0030 | 1.00 | 0.41 |
| EXAMPLE 21 | 560 | 5.9 | 0.984 | 7.6 | 2.9 | 1.42 | 0.0029 | 1.00 | 0.86 |
| EXAMPLE 22 | 730 | 7.8 | 0.984 | 6.8 | 3.2 | 1.15 | 0.0032 | 1.00 | 0.44 |
| EXAMPLE 23 | 690 | 7.2 | 0.984 | 6.9 | 3.4 | 1.16 | 0.0031 | 1.00 | 0.38 |
| EXAMPLE 24 | 680 | 7.3 | 0.980 | 6.7 | 3.4 | 1.15 | 0.0032 | 1.00 | 0.36 |

TABLE 5

| | Low-temperature low-humidity environment | | | | High-temperature high-humidity environment | | | |
|---|---|---|---|---|---|---|---|---|
| | Cleaning failure | Image density (early stage) | Image density (at the end) | Fogging | Toner scattering | Image density (early stage) | Image density (at the end) | Fogging |
| EXAMPLE 18 | A | A | A | A | A | A | A | A |
| EXAMPLE 19 | A | A | A | A | A | A | A | A |
| EXAMPLE 20 | A | A | A | A | A | A | A | A |
| EXAMPLE 21 | A | A | A | A | A | A | A | A |
| EXAMPLE 22 | A | A | A | A | A | A | A | A |
| EXAMPLE 23 | A | A | A | A | A | A | A | A |
| EXAMPLE 24 | A | A | A | A | A | A | A | A |

Example 25

The image quality was examined by a 5,000-sheet full-color image printing test using a full-color printer LBP 2510, manufactured by Canon Inc, using 150 g of the toner of EXAMPLE 1 as the cyan toner, 150 g of the toner of EXAMPLE 22 as the magenta toner, 150 g of the toner of EXAMPLE 23 as the yellow toner, and 150 g of the toner of EXAMPLE 1 as the black toner. Each toner was accommodated in a corresponding cartridge. The image quality was tested as in EXAMPLE 1. The results are shown in Table 6.

TABLE 6

| | Low-temperature low-humidity environment | | | | High-temperature high-humidity environment | | | |
|---|---|---|---|---|---|---|---|---|
| | Cleaning failure | Image density (early stage) | Image density (at the end) | Fogging | Toner scattering | Image density (early stage) | Image density (at the end) | Fogging |
| EXAMPLE 25 | A | A | A | A | A | A | A | A |

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner comprising:

(a) toner particles comprising a binder resin, a coloring agent, a releasing agent, and a sulfur-containing resin; and (b) an inorganic fine powder mixed with the toner particles, wherein i) the toner particles contain at least one element selected from the group consisting of magnesium, calcium, barium, zinc, aluminum, and phosphorous and satisfy the relationship:

$$4 \leqq T/S \leqq 30$$

wherein T is from 100 to 1,000 ppm and represents the total content of said element, and S represents the sulfur content in terms of ppm;

ii) the weight-average particle diameter (D4) of the toner is in the range of 3 to 10 μm; and iii) the average circularity of the toner is within the range of 0.950 to 0.995.

2. The toner according to claim 1, wherein the following relationship is satisfied:

$$(S\text{-}f) \geqq (S\text{-}m)$$

wherein (S-f) represents the sulfur content in finer particles obtained by air-classifying the toner and (S-m) represents the sulfur content in the toner, the finer particles being air-classified particles satisfying the following relationship:

$$\{D4 \text{ of the toner} \times 0.7\} \leqq D4 \text{ of the finer particles} \leqq \{D4 \text{ of the toner} \times 0.8\}.$$

3. The toner according to claim 1, wherein the following relationship is satisfied:

$$0.0003 \leqq E/A \leqq 0.0050$$

wherein E represents the content of sulfur on the toner surfaces and A represents the content of carbon on the toner surfaces in terms of atomic percent measured by X-ray photoelectron spectrometry.

4. The toner according to claim 1, wherein the following relationship is satisfied:

$$0.0005 \leqq F/A \leqq 0.0100$$

wherein F represents the content of nitrogen on the toner surfaces and A represents the content of carbon on the toner surfaces in terms of atomic percent measured by X-ray photoelectron spectrometry.

5. The toner according to any one of claims 1 to 4, wherein the following relationship is satisfied:

$$1 \leqq F/E \leqq 8$$

wherein F represents the content of nitrogen on the toner surfaces and E represents the content of sulfur on the toner surfaces in terms of atomic percent measured by X-ray photoelectron spectrometry.

6. The toner according to claim 5, wherein the following relationship is satisfied:

$$1 \leqq F/E \leqq 6.$$

7. The toner according to claim 5, wherein the following relationship is satisfied:

$$2 \leqq F/E \leqq 8.$$

8. The toner according to claim 5, wherein the following relationship is satisfied:

$$2 \leqq F/E \leqq 6.$$

9. The toner according to claim 1, wherein the inorganic fine powder is one of silica, titanium oxide, alumina, and a complex oxide thereof.

10. The toner according to claim 1, wherein the inorganic fine powder is hydrophobized inorganic fine powder.

11. The toner according to claim 10, wherein the inorganic fine powder is hydrophobized with a silane compound and/or silicone oil.

12. The toner according to claim 1, wherein the inorganic fine powder comprises silica, and the percentage of free silica is within the range of 0.05% to 5.00% based on the number of the silica.

13. The toner according to claim 1, wherein the average circularity of the toner is in the range of 0.960 to 0.995.

14. The toner according to claim 1, wherein the mode circularity of the toner is at least 0.99.

15. The toner according to claim 1, wherein the weight-average particle diameter (D4) is in the range of 4 to 8 μm.

16. The toner according to claim 1, wherein the toner is nonmagnetic.

17. The toner according to claim 1, wherein the toner particles are prepared in an aqueous medium.

18. The toner according to claim 17, wherein the toner particles are prepared by suspension polymerization.

* * * * *